US010622751B2

(12) United States Patent
Hara et al.

(10) Patent No.: US 10,622,751 B2
(45) Date of Patent: Apr. 14, 2020

(54) CONNECTOR

(71) Applicants: AutoNetworks Technologies, Ltd., Yokkaichi-shi, Mie (JP); Sumitomo Wiring Systems, Ltd., Yokkaichi-shi, Mie (JP); SUMITOMO ELECTRIC INDUSTRIES, LTD., Osaka-shi, Osaka (JP); TOYOTA JIDOSHA KABUSHIKI KAISHA, Toyota-shi, Aichi-ken (JP)

(72) Inventors: Teruo Hara, Yokkaichi (JP); Hajime Kawase, Yokkaichi (JP); Masaaki Tabata, Yokkaichi (JP); Tetsuya Miyamura, Yokkaichi (JP); Yasuo Omori, Yokkaichi (JP); Shunya Takeuchi, Yokkaichi (JP); Hiroki Kobayashi, Yokkaichi (JP); Hisashi Kojima, Yokkaichi (JP); Takeshi Misaiji, Seto (JP); Hiroshi Kobayashi, Okazaki (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP); TOYOTA JIDOSHA KABUSHIKI KAISHA (JP)

( * ) Notice: Subject to any disclaimer, the term of this patent is extended or adjusted under 35 U.S.C. 154(b) by 0 days.

(21) Appl. No.: 16/272,128

(22) Filed: Feb. 11, 2019

(65) Prior Publication Data

US 2019/0252815 A1 Aug. 15, 2019

(30) Foreign Application Priority Data

Feb. 15, 2018 (JP) ..... 2018-025368

(51) Int. Cl.
*H01R 13/502* (2006.01)
*H01R 4/2425* (2018.01)
(Continued)

(52) U.S. Cl.
CPC ..... *H01R 13/502* (2013.01); *H01R 4/2425* (2013.01); *H01R 13/422* (2013.01);
(Continued)

(58) Field of Classification Search
CPC ..... H01R 13/501; H01R 13/582–5829; H01R 13/502; H01R 13/4362; H01R 13/5205;
(Continued)

(56) References Cited

U.S. PATENT DOCUMENTS 4,023,879 A * 5/1977 Braund ..... H01R 13/26 439/76.1
4,606,596 A * 8/1986 Whiting ..... H01R 13/58 439/465
(Continued)

FOREIGN PATENT DOCUMENTS

JP 2016-009527 1/2016

*Primary Examiner* — Gary F Paumen
(74) *Attorney, Agent, or Firm* — Gerald E. Hespos; Michael J. Porco; Matthew T. Hespos

(57) ABSTRACT

A connector includes terminals (14) connected to terminal ends of electrical wires (12); a housing (20) including a terminal housing chamber (21) in which the terminals (14) are housed and an electrical wire lead-out portion (24) from which the electrical wires (12) are led out. A first cover (50A) covers the electrical wires (12) led out from the electrical wire lead-out portion (24), and a second cover (50B) causes the electrical wires (12) to be inserted between the second cover 50B itself and the first cover (50A) in a state of being assembled to the first cover (50A). At least one of the first and second covers (50A, 50B) includes electrical wire pressing portions (56A, 56B) that press the electrical
(Continued)

wires (12) led out from the electrical wire lead-out portion (24) when the first and second covers (50A, 50B) are assembled together.

10 Claims, 27 Drawing Sheets

(51) Int. Cl.
*H01R 13/436* (2006.01)
*H01R 13/52* (2006.01)
*H01R 13/422* (2006.01)
*H01R 13/58* (2006.01)

(52) U.S. Cl.
CPC ..... *H01R 13/4362* (2013.01); *H01R 13/5205* (2013.01); *H01R 13/5812* (2013.01); *H01R 13/5808* (2013.01)

(58) Field of Classification Search
CPC ..... H01R 13/422; H01R 13/5812; H01R 13/5808
USPC ..... 439/465–467
See application file for complete search history.

(56) References Cited

U.S. PATENT DOCUMENTS 4,900,277 A * 2/1990 Inaba ..... H01R 13/56 439/465
5,066,243 A * 11/1991 Nuesslein ..... H01R 13/422 439/460
5,133,674 A * 7/1992 Albrecht ..... H01R 12/772 439/465
5,908,327 A * 6/1999 Tsuji ..... H01R 13/506 439/470
6,250,972 B1 * 6/2001 Shinchi ..... H01R 13/504 439/465
6,478,609 B1 * 11/2002 Davis ..... H01R 13/5812 439/465
6,878,009 B2 * 4/2005 Amemiya ..... H01R 13/5812 439/467
7,476,121 B2 * 1/2009 Tsuji ..... H01R 13/4223 439/465
2001/0005651 A1 * 6/2001 Saito ..... H01R 12/592 439/465
2001/0016450 A1 * 8/2001 Gutris ..... H01R 13/501 439/467
2010/0233900 A1 * 9/2010 Gimbel ..... H01R 13/5829 439/467

* cited by examiner

CONNECTOR

BACKGROUND

Field of the Invention

The present description discloses a technology regarding a connector.

Related Art

Heretofore, there has been known a connector configured such that a housing houses a plurality of terminals connected to terminal ends of a plurality of electrical wires. A connector in Japanese Unexamined Patent Application Publication No. 2016-9527 includes: terminals to which electrical wires are connected; and a housing in which a terminal housing portion housing the terminals is formed, and by lances protruding from an inner wall of the terminal housing portion, the terminals are prevented from coming off. The plurality of electrical wires are pulled out from an open end of the housing, and are wound fixed by an adhesive tape around an electrical wire holding member extended downward from an end surface of the housing.

Incidentally, in the configuration of engaging the terminals with the lances and preventing the terminals from coming off, when force in a direction where the electrical wires come off is applied to the electrical wires pulled out from the open end of the housing, a stress is generated in connection portions between the terminals and the electrical wires, and there is concern over a damage and the like of the connection portions between the terminals and the electrical wires. In Patent Document 1, the electrical wires pulled out from the open end of the housing are wound and held around the electrical wire holding member by the adhesive tape and the like; however, in this case, there is a problem that it takes time and labor to perform winding work of the adhesive tape and the like.

A technology described in the present description is completed on the basis of such circumstances as described above. It is an object of the technology to provide a connector configured to suppress the damage of the connection portions between the terminals and the electrical wires while simplifying an assembly process therefor.

SUMMARY

A connector described in the present description includes: a terminal connected to a terminal end of an electrical wire; a housing including a terminal housing chamber in which the terminal is housed and an electrical wire lead-out portion from which the electrical wire housed in the terminal housing chamber is led out; a first cover that covers the electrical wire led out from the electrical wire lead-out portion; and a second cover that causes the electricl wire to be inserted between the second cover itself and the first cover in a state of being assembled to the first cover. At least one of the first cover and the second cover includes an electrical wire pressing portion that presses the electrical wire led out from the electrical wire lead-out portion in the state where the first cover and the second cover are assembled to each other.

In accordance with the present configuration, the first cover and the second cover are assembled to each other, whereby the electrical wires led out from the electrical wire lead-out portion of the housing are pressed by the electrical wire pressing portion of at least one of the first cover and the second cover. In this way, even if force in a direction where the terminals come off is applied to the electrical wires, the electrical wire pressing portion presses and holds the electrical wires led out of the electrical wire lead-out portion, and accordingly, a stress generated on the terminals is suppressed. Hence, it becomes possible to suppress the damage of the connection portions between the terminals and the electrical wires while simplifying the assembly process.

As embodied aspects of the technology described in the present description, the following aspects are preferable.

At least one of the first cover and the second cover may include: a cover body having the electrical wire pressing portion; and an openable and closable opening and closing portion connected to the cover body via a hinge portion.

With such a configuration, the opening and closing portion is opened in the state where the first cover and the second cover are assembled to each other, whereby a work space for work of bundling the electrical wires can be ensured.

A plurality of the terminals connected to terminal ends of a plurality of the electrical wires may be provided, the plurality of electrical wires led out from the electrical wire lead-out portion may be arrayed in an assembly direction of the first cover and the second cover, and a spacer portion sandwiched between the plurality of electrical wires arrayed in the assembly direction of the first cover and the second cover may be provided.

In the configuration in which the plurality of electrical wires are arrayed in the assembly direction of the first cover and the second cover, there is concern that the force by which the electrical wire pressing portions press the electrical wires may decrease by gaps between the electrical wires. In accordance with the present configuration, the electrical wire pressing portions press the electrical wires in the state where the spacer portion is sandwiched between the plurality of electrical wires, and accordingly, the electrical wire holding force by the electrical wire pressing portions can be suppressed from decreasing.

The electrical wire lead-out portion may be recessed with respect to an outer surface of the housing, and the spacer portion may include a tapered portion that has a tapered shape and enters the electrical wire lead-out portion.

In this way, it becomes easy to assemble the spacer portion, and it becomes easy to position the spacer portion between the electrical wires.

The housing may include an overhang portion that overhangs outward, and the first cover and the second cover may include fitting portions which fit into the overhang portion in the assembly direction of the first cover and the second cover.

In this way, it becomes possible to position the first cover and the second cover with respect to the housing while facilitating the assembly work of the first cover and the second cover by the fitting portions.

At least one of the first cover and the second cover may hold a tying member that ties the plurality of electrical wires.

In accordance with the technology described in the present description, there can be provided the connector configured to suppress the damage of the connection portions between the terminals and the electrical wires while simplifying the assembly process therefor.

DETAILED DESCRIPTION

First Embodiment

A first embodiment will be described with reference to FIG. 1 to FIG. 17.

A connector 10 of the present embodiment is mounted on a vehicle, for example, such as an automobile, and fits into a mating connector connected to an electrical wire terminal end, an instrument or the like. Hereinafter, a description will be given on the premise that, in FIG. 1, an X-direction is forward, a Y-direction is leftward, and a Z-direction is upward.

Figure 1:
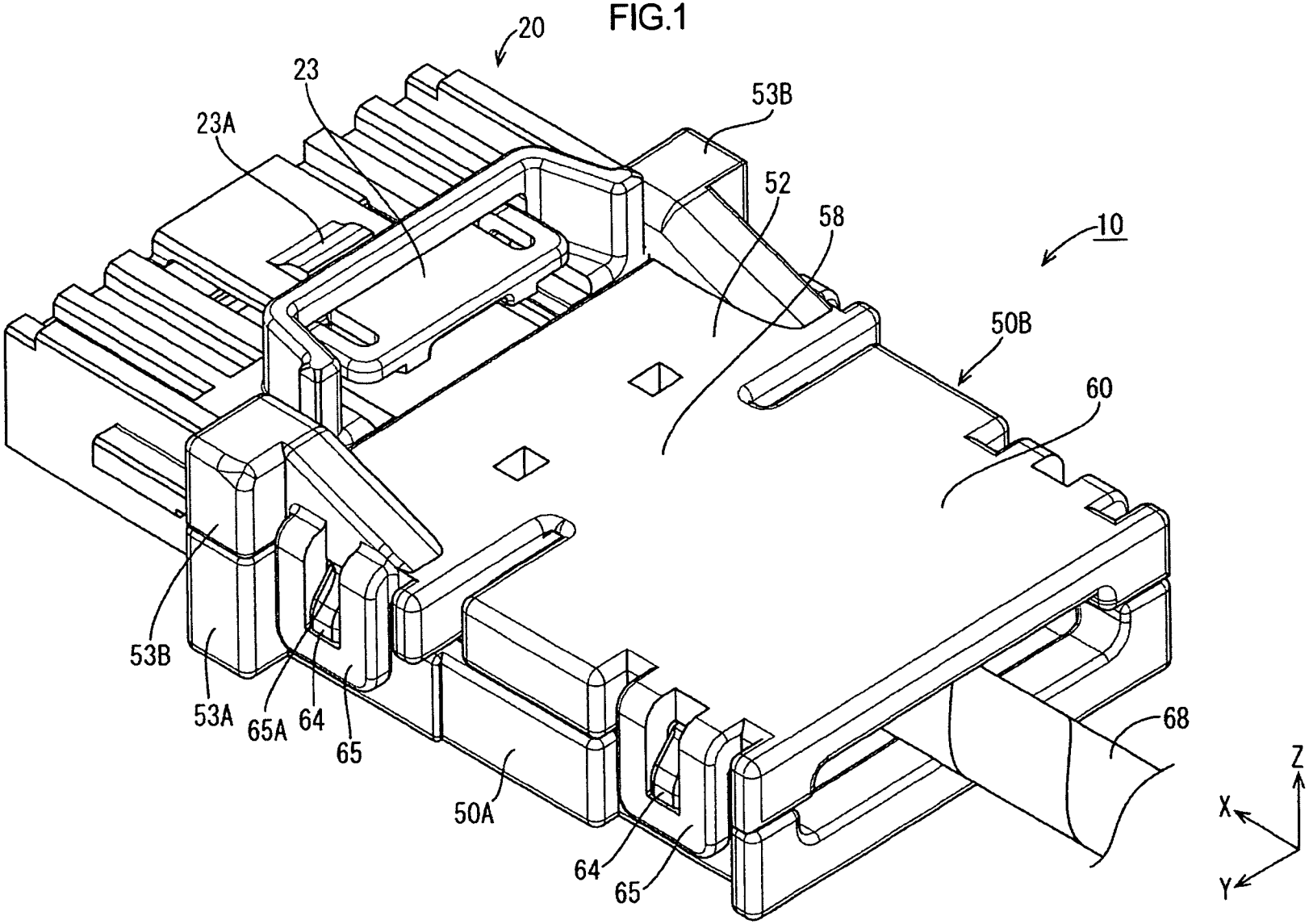
FIG. 1 is a perspective view showing a connector of a first embodiment.
Figure 2:
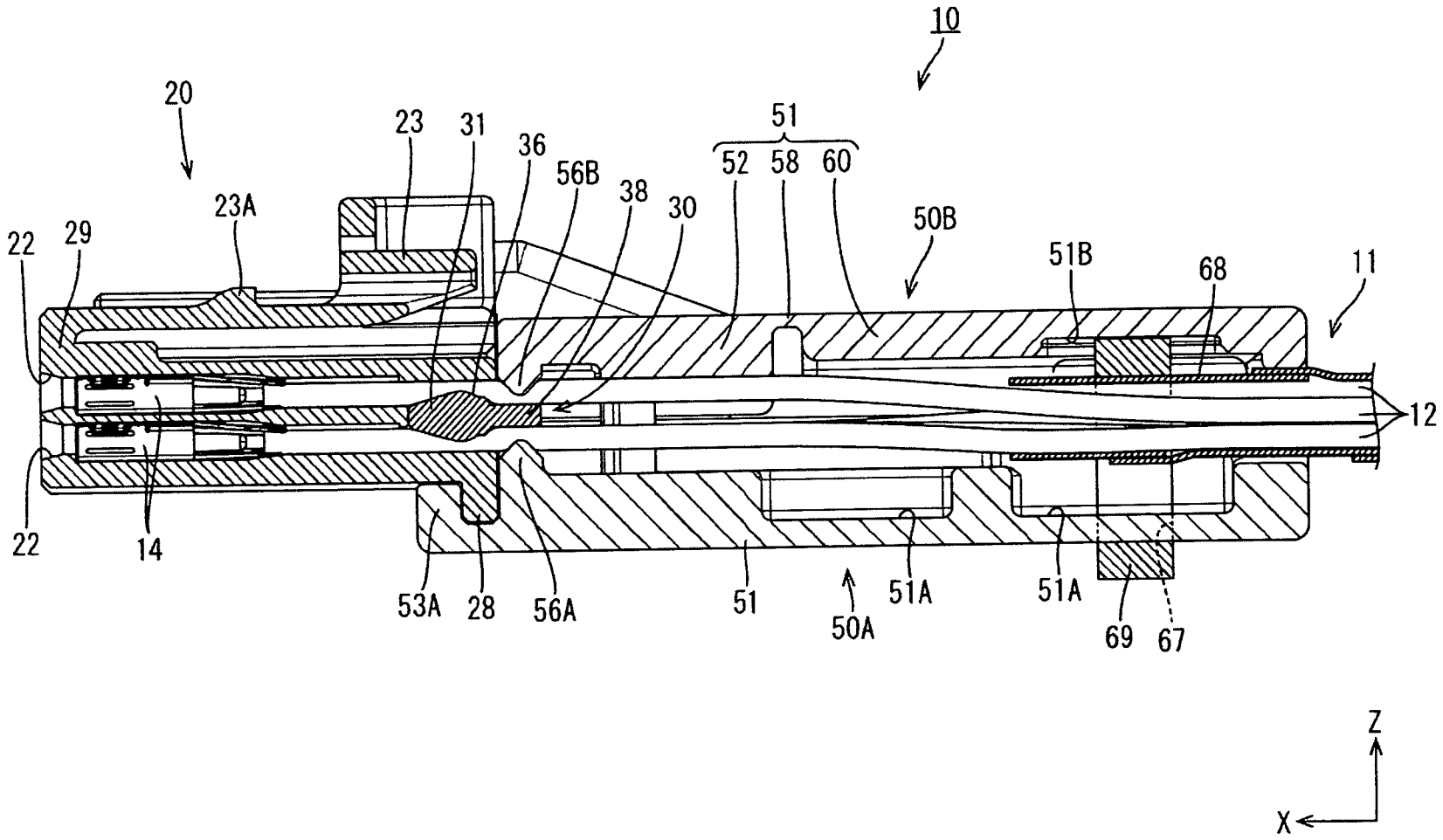
FIG. 2 is a longitudinal sectional view of an intermediate portion in a width direction of the connector.
Figure 3:
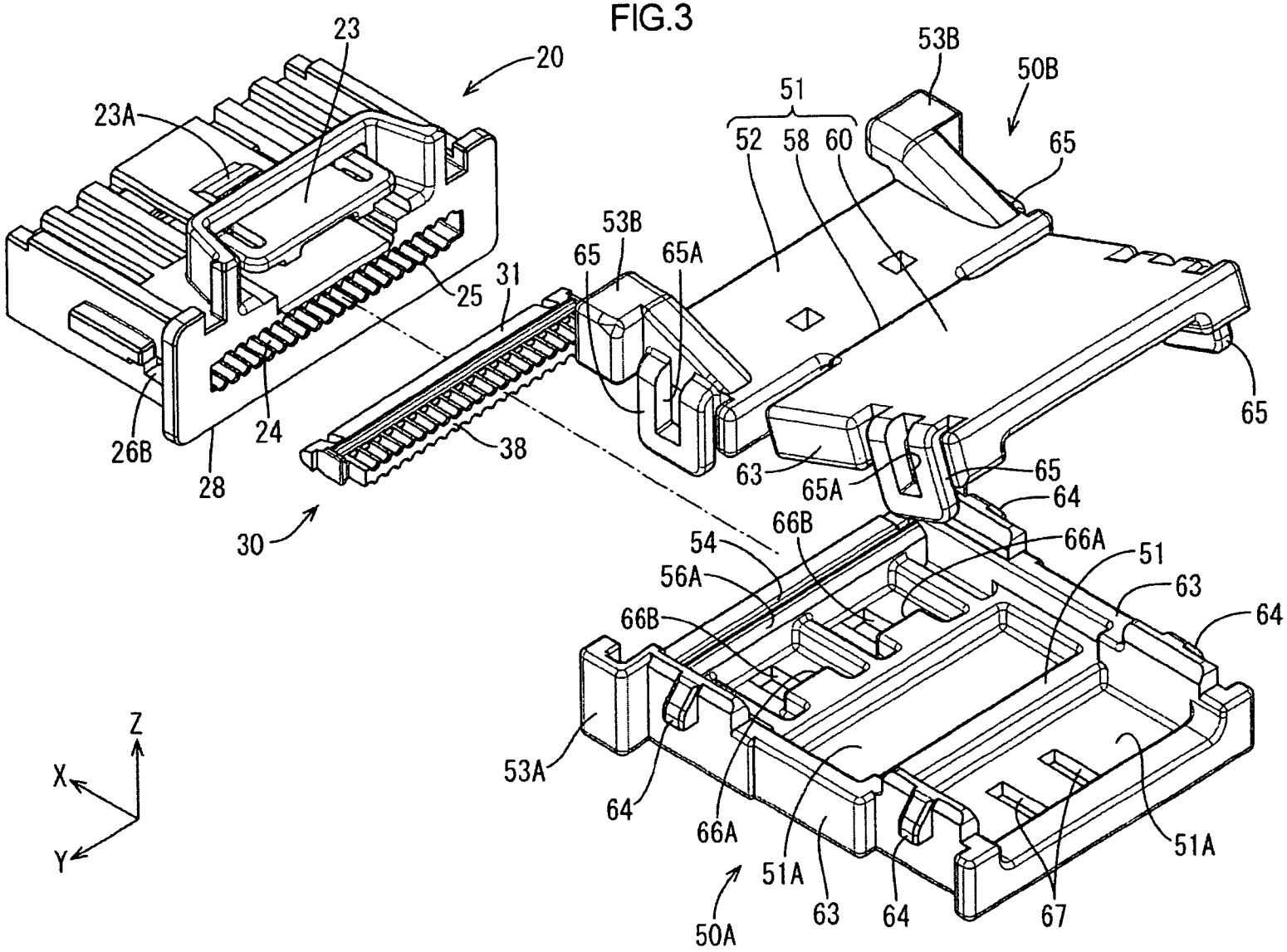
FIG. 3 is an exploded perspective view of the connector.

As shown in FIG. 2 and FIG. 3, the connector 10 includes: a plurality of terminal-attached electrical wires 11; a synthetic resin-made housing 20 in which the plurality of terminal-attached electrical wires 11 are housed; and a pair of covers 50A and 50B disposed behind the housing 20.

Figure 4:
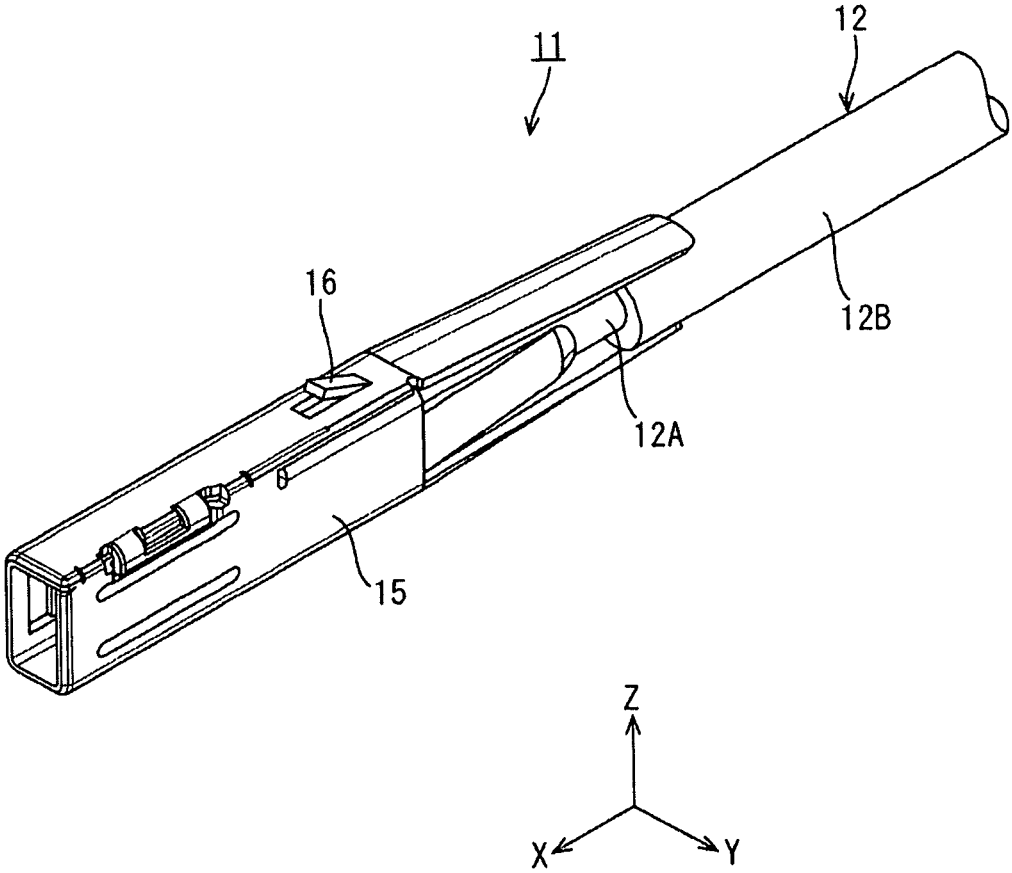
FIG. 4 is a perspective view showing a terminal-attached electrical wire.

As shown in FIG. 4, each of the terminal-attached electrical wires 11 is composed in such a manner that a terminal 14 is connected to a terminal end of an electrical wire 12. In each of the electrical wires 12, a periphery of a conductor 12A made of copper, a copper alloy, aluminum, an aluminum alloy or the like is covered with an insulative coating 12B. Each terminal 14 is a female terminal made of metal such as copper, a copper alloy, aluminum, an aluminum alloy or the like, and includes a rectangular tube-shaped box portion 15 in which an elastic contact piece connected to a mating male terminal. The conductor 12A of the electrical wire 12 is connected to the terminal 14 by known connecting means, for example, such as welding, pressure welding and pressure bonding. A flexurally deformable metal lance 16 is formed on an outer surface of the box portion 15. The metal lance 16 is engaged with a recessed portion (not shown) on an inner wall of terminal housing chamber 21 of the housing 20, thereby preventing the terminal 14 from coming off.

Figure 5:
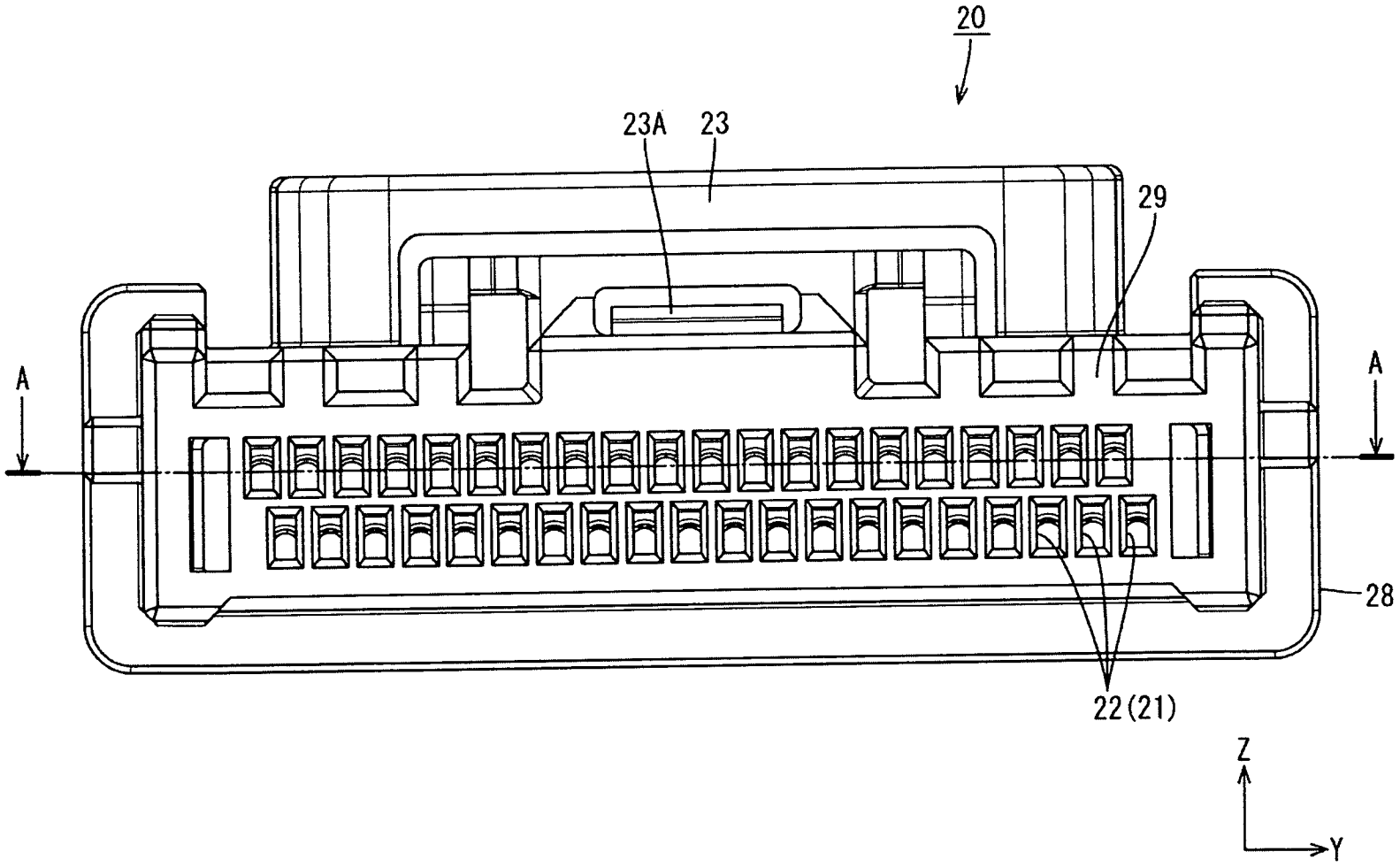
FIG. 5 is a front view showing a housing.
Figure 6:
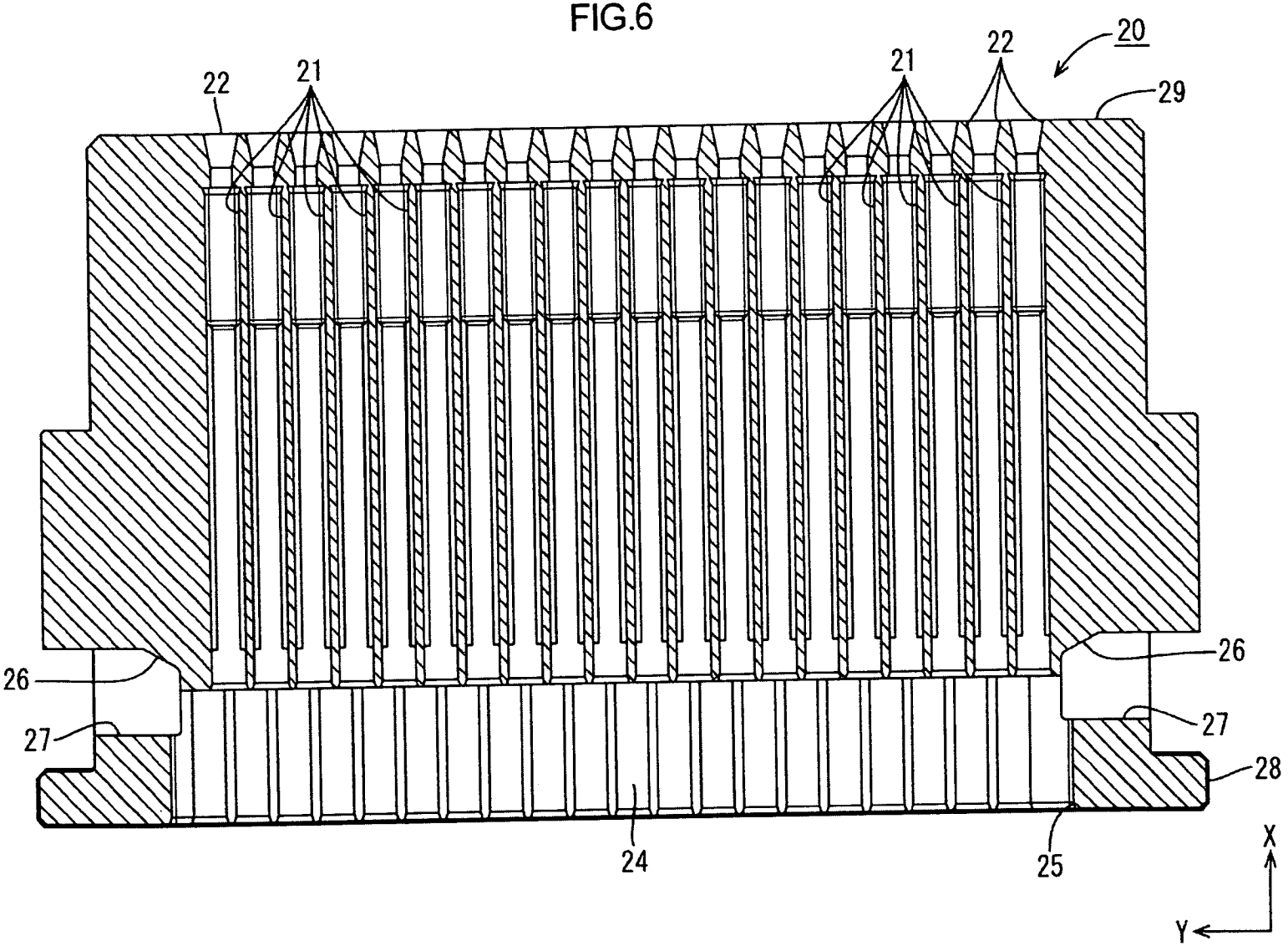
FIG. 6 is an A-A cross-sectional view of FIG. 5.

As shown in FIG. 5 and FIG. 6, in the housing 20, a large number (plurality) of the terminal housing chambers 21 having a flat cuboidal shape are provided crosswise in line on two upper and lower stages. Each of the terminal housing chambers 21 is formed into a shape, for example, that enables each of the terminals 14 to be inserted from the rear of the housing 20. In a front wall 29 that closes a front side of the housing 20, terminal insertion holes 22 into which the male terminals of the mating connector (not shown) are to be inserted are opened, and the terminal housing chambers 21 are disposed behind the terminal insertion holes 22. The terminal housing chambers 21 (and the terminal insertion holes 22) on the two upper and lower stages are arranged in a staggered manner, and in a crosswise direction, an intermediate (axial center) in a width direction of each of the terminal housing chambers 21 is disposed at an intermediate portion between the terminal housing chambers 21 adjacent to each other on the upper stage.

In an upper portion of the housing 20, a lock arm 23 that locks a fitted state to the mating connector housing is formed. On the lock arm 23, there is formed a locking protrusion 23A that engages with the mating connector housing in a normal fitting state. On a rear end portion of the housing 20, an overhang portion 28 that bulges outward in a flange shape is formed. The overhang portion 28 continues with rear end portions of a pair of side walls and a bottom wall in an entire periphery of the rear end portion of the housing 20, and is provided on crosswise end portions of an upper wall thereof on which the lock arm 23 is provided.

Figure 10:
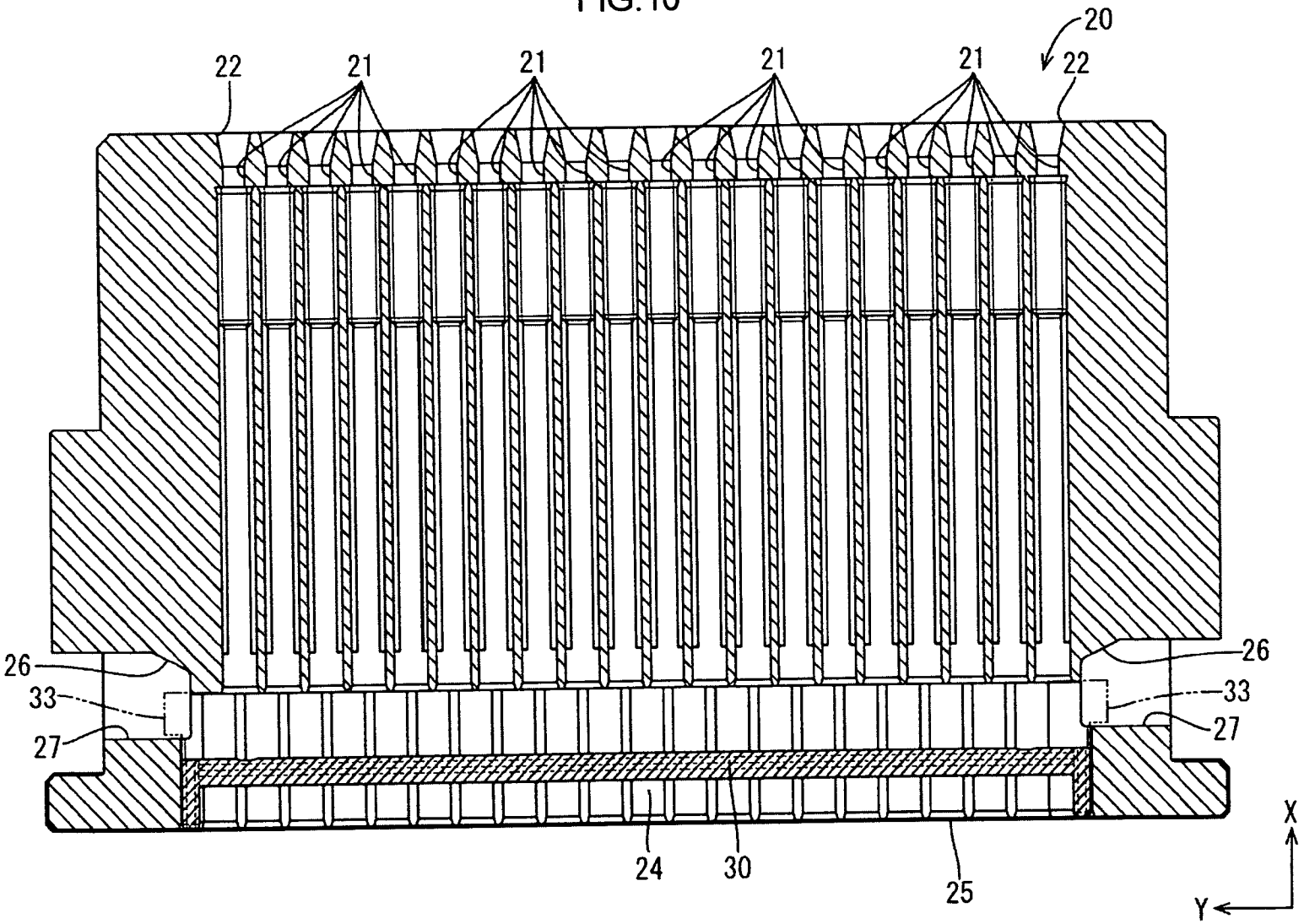
FIG. 10 is a planar sectional view showing a state where the tip end portion of the spacer portion is inserted into the electrical wire lead-out portion of the housing.

As shown in FIG. 10, on a rear of both side walls of the housing 20, engaging recessed portions 26 are formed by cutting off the side walls. The engaging recessed portions 26 have step difference surfaces 27 that engages with the spacer portion 30. A space behind the terminal housing chambers 21 (the rear end portion of the housing 20) is formed as an electrical wire lead-out portion 24 that forms a space from which all (plurality) of the electrical wires 12 are led out. A front end of the spacer portion 30 to be described later enters the electrical wire lead-out portion 24. An inner wall of the electrical wire lead-out portion 24 is formed into a wave-form shape so as to go along outer circumferences of the electrical wires 12. In a rear end portion of the electrical wire lead-out portion 24, an electrical wire lead-out port 25 that leads out the electrical wires 12 between the pair of covers 50A and 50B is opened.

Figure 7:
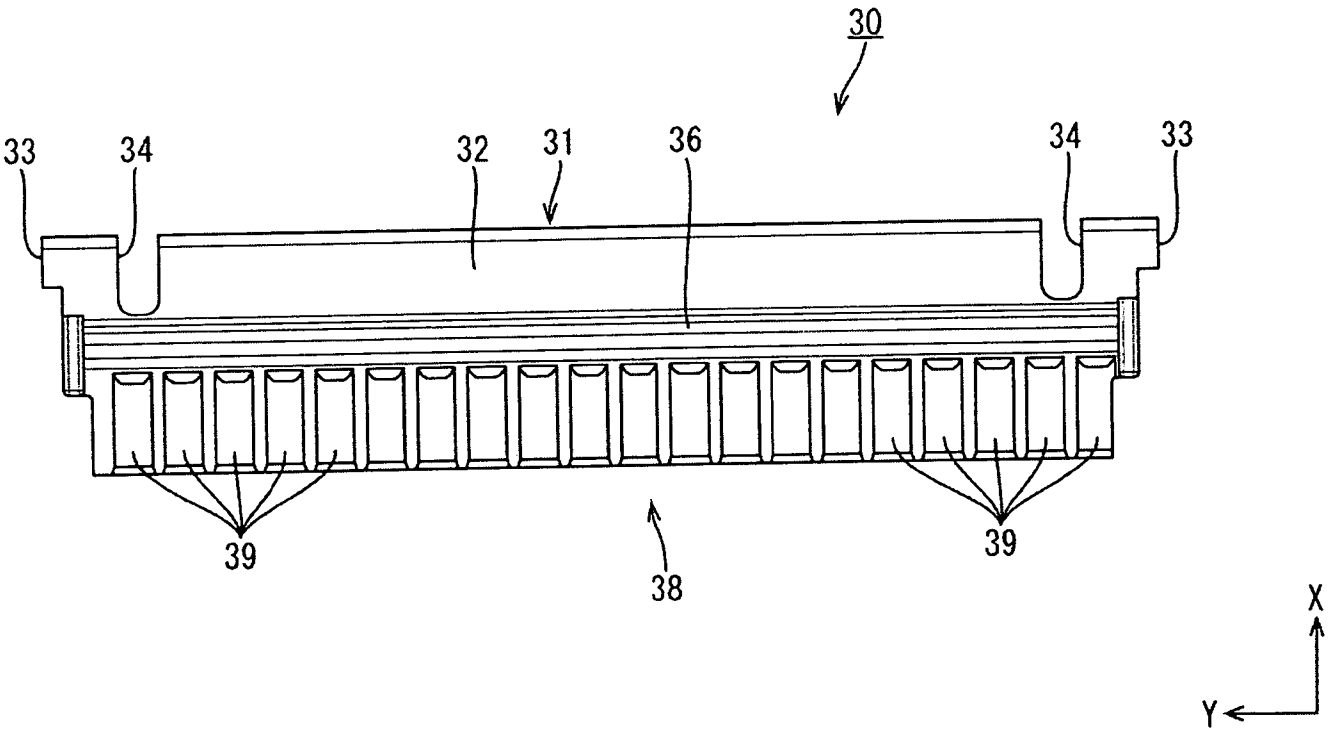
FIG. 7 is a plan view showing a spacer portion.
Figure 8:
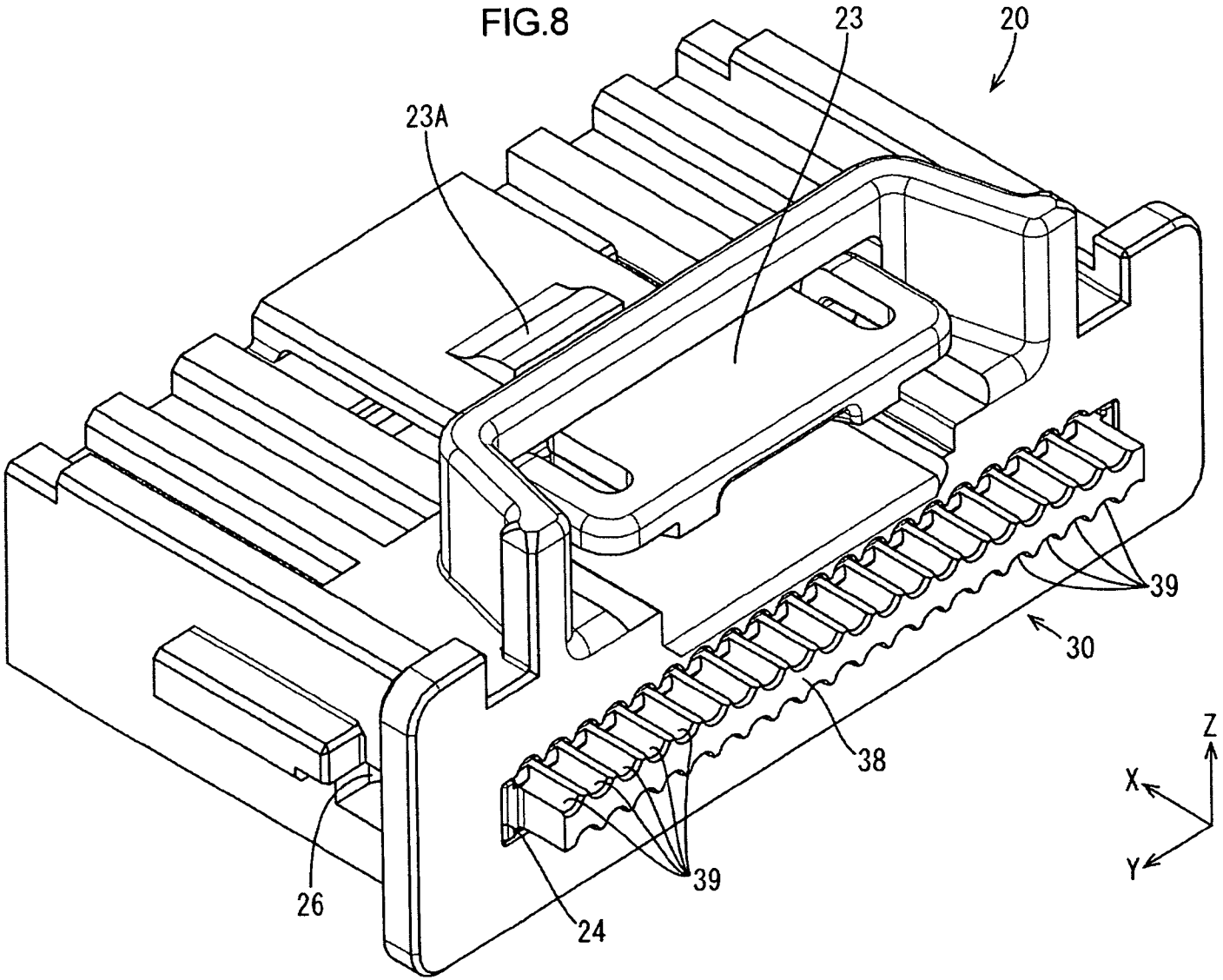
FIG. 8 is a perspective view showing a state where a tip end portion of the spacer portion is inserted into an electrical wire lead-out portion of the housing.
Figure 9:
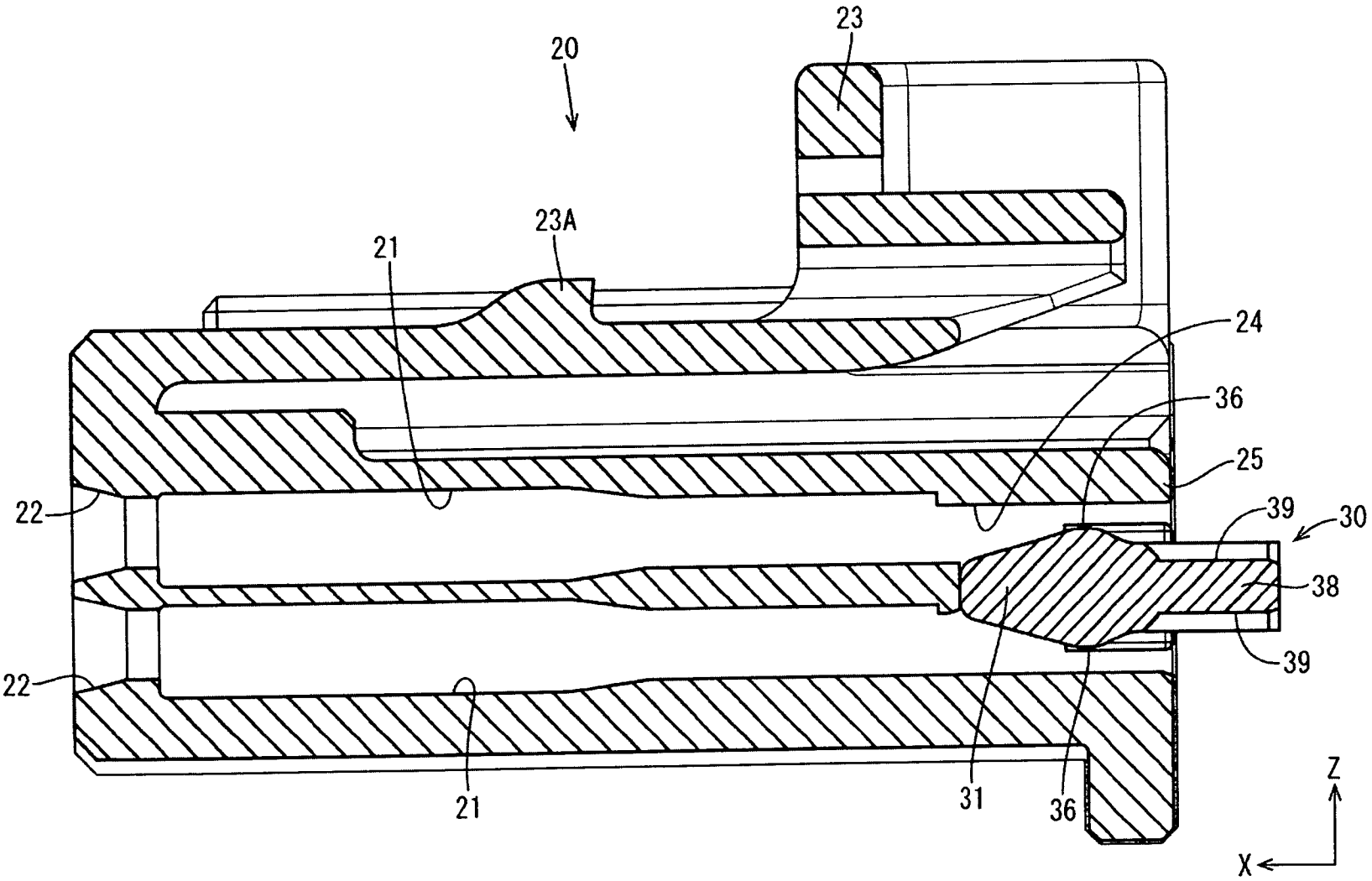
FIG. 9 is a longitudinal sectional view showing a state where the tip end portion of the spacer portion is inserted into the electrical wire lead-out portion of the housing.

For example, the spacer portion 30 is made of synthetic resin or metal, and as shown in FIG. 7 to FIG. 9, has a shape extending crosswise along an arrayed direction of the electrical wires 12. The spacer portion 30 includes: a tapered portion 31 having a tapered shape; a thick portion 36 continuous with a rear of the tapered portion 31 and increased in a thickness dimension; and a plate-shaped electrical wire mounting portion 38 extending rear of the thick portion 36 and configured to mount the electrical wires 12 thereon.

The tapered portion 31 has a substantially triangular cross section, and upper and lower surfaces thereof are formed as inclined surfaces 32 configured to be in slidingly contact with the outer circumferences of the electrical wires 12 at a time of inserting the spacer portion 30. On end portions in a width direction of the tapered portion 31, a pair of engaging protruding portions 33 and 33 which engages with the engaging recessed portions 26 of the housing 20 is provided so as to protrude outward. In insides of the pair of engaging protruding portions 33 and 33, a pair of cut-off portions 34 having a shape in which the tapered portion 31 is cut off is formed. The engaging protruding portions 33 are made flexurally deformable inward by the cut-off portions 34.

The thick portion 36 is increased in the thickness dimension more than the tapered portion 31 and the electrical wire mounting portion 38, and at a time of being inserted between the electrical wires 12 located on the upper and lower stages (FIG. 13), the thick portion 36 abuts against outer circumferential surfaces of the coatings 12B of the electrical wires 12, presses outer circumferential surfaces of the electrical wires 12, and holds the electrical wires 12 while slightly deforming the same. On both upper and lower surfaces of the electrical wire mounting portion 38, a plurality of electrical wire cabling grooves 39 which go along the outer circumferences of the electrical wires 12 are formed crosswise in line. The respective electrical wire cabling grooves 39 extend crosswise in a waveform shape so as to go along the outer circumferential surfaces of the electrical wires 12. The plurality of upper and lower electrical wire cabling grooves 39 of the electrical wire mounting portion 38 continue with the rear of the respective terminal housing chambers 21 of the housing 20 and are arranged in a staggered manner, and in the crosswise direction, an intermediate (axial center) in a width direction of the electrical wire cabling grooves 39 on a lower surface side of the electrical wire mounting portion 38 is disposed at an intermediate portion between the electrical wire cabling grooves adjacent to each other on an upper surface side of the electrical wire mounting portion 38. As described above, crosswise positions of the upper and lower electrical wire cabling grooves 39 are shifted from each other, whereby spots in each of which a thickness of the electrical wire mounting portion 38 is locally decreased are reduced. Accordingly, electrical wire pressing portions 56A and 56B of the first cover 50A and the second cover 50B, which will be described later, press the electrical wires 12, whereby deformation of the electrical wire mounting portion 38 can be suppressed even in a state where a stress is generated in the electrical wire mounting portion 38.

Figure 17:
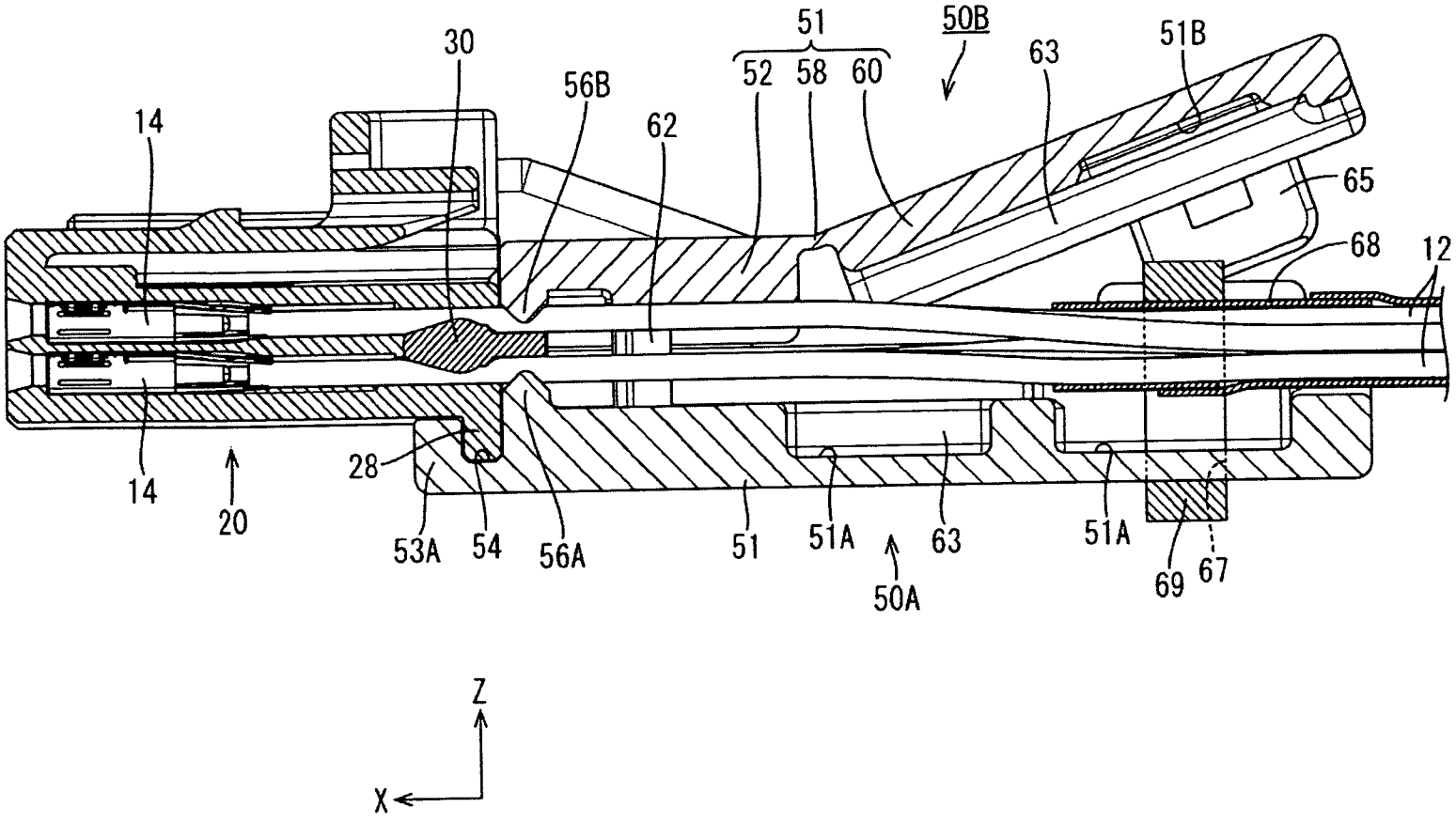
FIG. 17 is a longitudinal sectional view showing a state where, in the state where the opening and closing cover is opened, the fixed portion of the second cover is assembled to the first cover, and the plurality of electrical wires subjected to the tape winding are bundled by a tie band.
Figure 18:
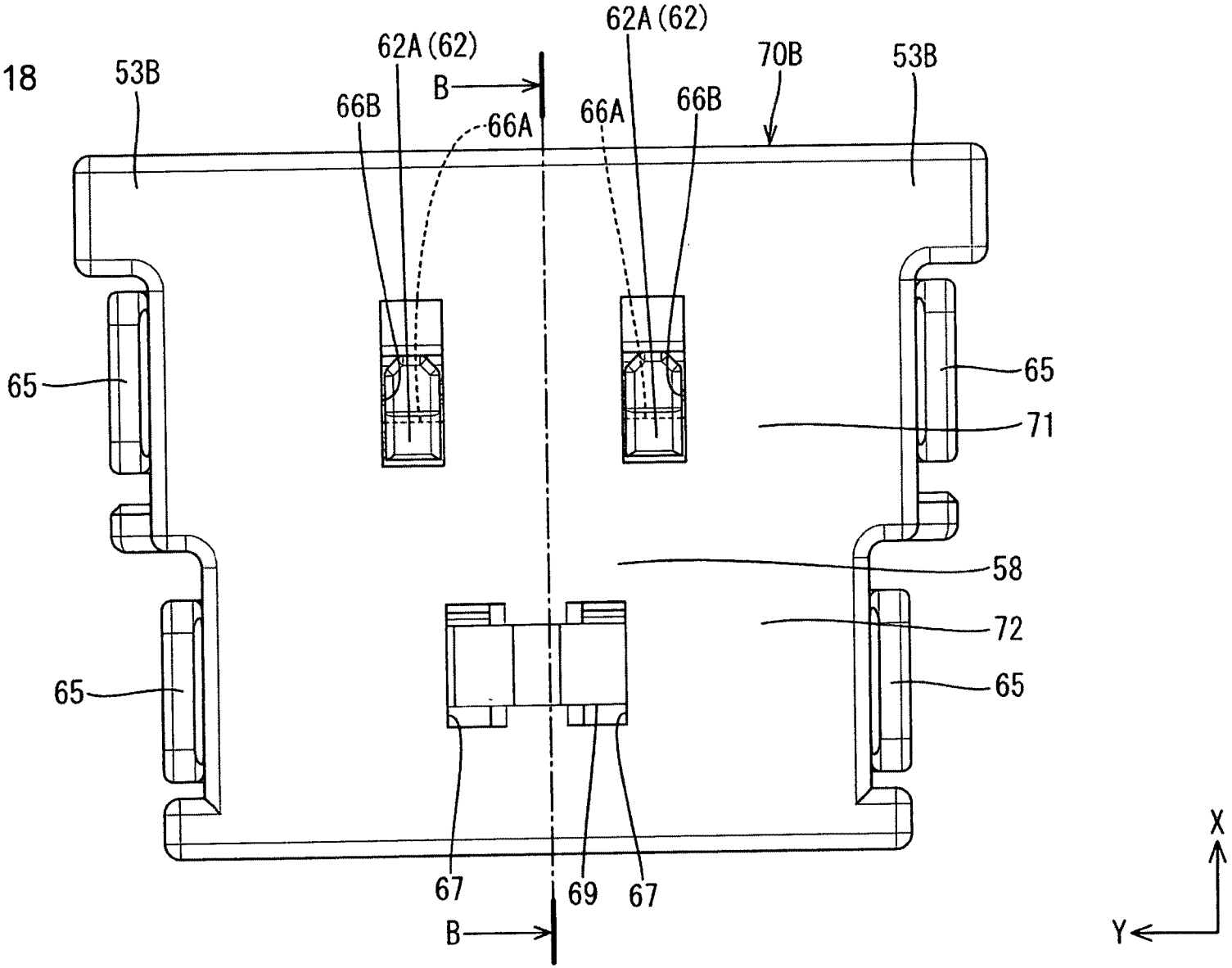
FIG. 18 is a bottom view showing a state where a pair of covers of a second embodiment is assembled.

The pair of covers 50A and 50B is made of insulative synthetic resin, includes the first cover 50A and the second cover 50B disposed at a position above the first cover 50A, which faces the first cover 50A, and as shown in FIG. 3 and FIG. 17, each of the covers 50A and 50B includes: a plate-shaped rectangular cover body 51; and a pair of side wall portions 63 erected from both edges of the cover body 51.

Figure 20:
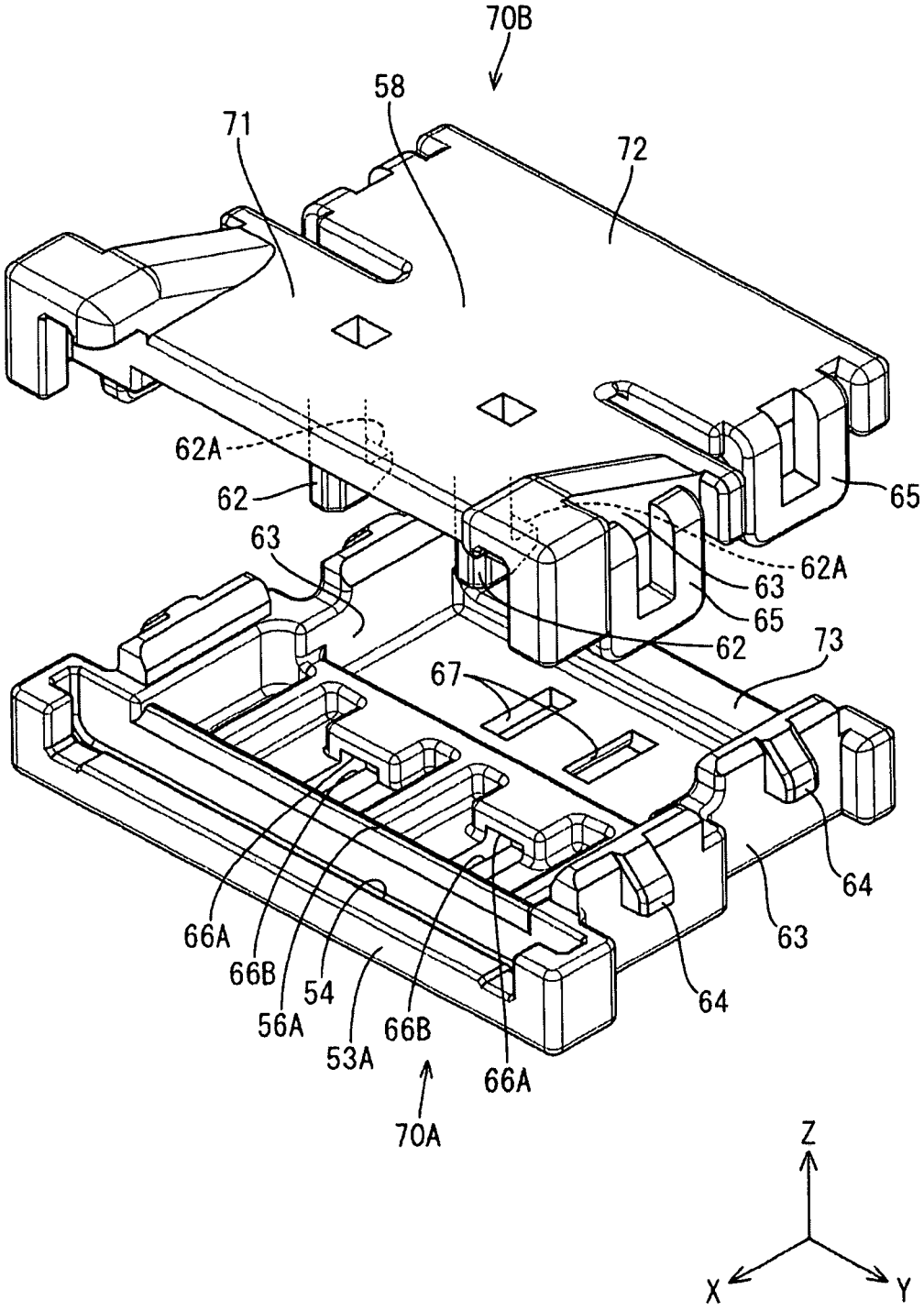
FIG. 20 is a perspective view showing the pair of covers.
Figure 21:
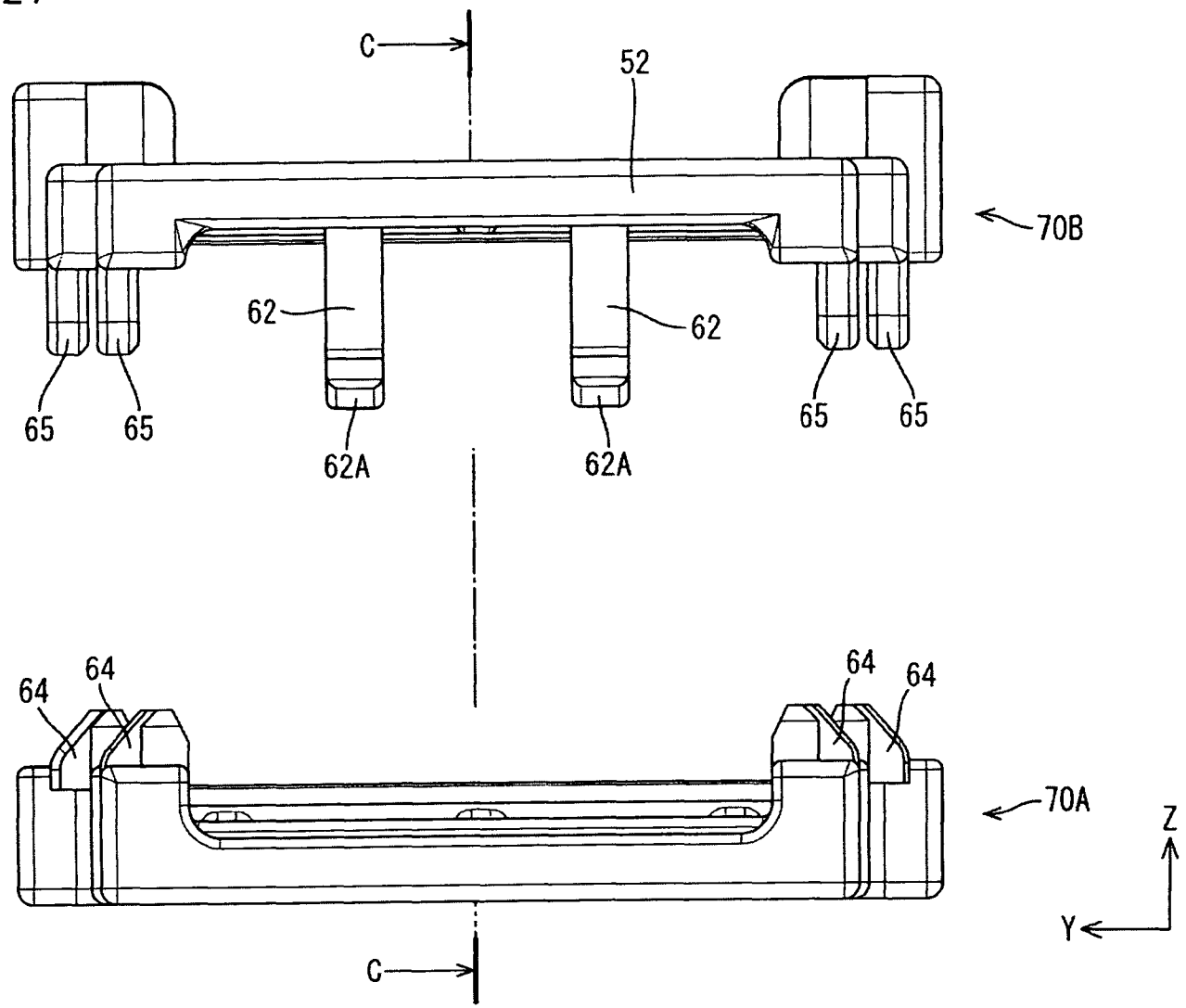
FIG. 21 is a rear view showing the pair of covers.

On an upper surface of the cover body 51 of the first cover 50A, there are formed: a plurality of recessed portions 51A; relief holes 66B which escape so as not to abut against lower end portions of engaging pieces 62 (refer to FIG. 20) of the second cover 50B; and receiving portions 66A which engage with engaging hooks 62A of the engaging pieces 62. In the recessed portion 51A on the rear, a pair of slit-shaped through holes 67 is formed to penetrate the recessed portion 51A, and a synthetic resin-made tie band 69 (refer to FIG. 2) as a tying member that bundles the plurality of electrical wires 12 is passed through the pair of through holes 67, whereby positions and shapes of the plurality of electrical wires 12 can be held. The tie band 69 has a cord shape, and is tied in an annular shape when other side of the cord shape is passed through the one-side through hole. Accordingly, the tie band 69 can hold the plurality of electrical wires 12 (and a tape 68) in a state where the electrical wires 12 and the tape 68 are tied to the cover body 51. As shown in FIG. 3, the receiving portions 66A protrude forward in a plate shape, and both side edges thereof extend downward and continue with the upper surface of the cover body 51. On outer surfaces of the side wall portions 63 of the first cover 50A, engaging portions 64 are protruded outward, and on outer surfaces of the side wall portions 63 of the second cover 50B, flexurally deformable engaged portions 65 to be engaged with the engaging portions 64 extend downward in a frame shape. Lower ends of the engaging portions 64 protrude outward in a step difference shape, and on upper end sides thereof, a protruding dimension thereof is gradually reduced. The engaged portions 65 abut against the engaging portions 64 and are flexurally deformed, and the engaging portions 64 are housed in engaging holes 65A of the engaged portions 65 due to restoration and deformation, and turn to an engaging state therewith.

On a front end portion of the cover body 51 of the first cover 50A, there are formed: fitting portions 53A which fit into the overhang portion 28 of the housing 20; and the electrical wire pressing portion 56A that protrudes toward the electrical wires 12 and presses the electrical wires 12. The fitting portion 53A is a portion that has a U-shape cross section and is provided on a corner portion of the front end portion of the cover 50A, and is provided across an overall width of the front end portion of the cover body 51. In the fitting portion 53A, a fitting groove 54 configured to fit into the overhang portion 28 from below is formed across the overall width. The fitting groove 54 fits into the overhang portion 28, thereby regulating movement of the first cover 50A in a direction different from an assembly direction thereof while guiding movement of the first cover 50A in the assembly direction.

The electrical wire pressing portion 56A presses the coatings 12B of the electrical wires 12 when the pair of covers 50A and 50B is assembled to each other, and extends across an overall width between the right and left side wall portions 63 in the first cover 50A. As shown in FIG. 2, a tip end of the electrical wire pressing portions 56A is rounded and protrudes in a tapered shape, and a protruding dimension thereof is set to a dimension in which it is possible to prevent the electrical wires 12 from coming off without damaging the electrical wires 12.

The cover body 51 of the second cover 50B includes: a substantially rectangular flat plate-shaped fixed portion 52 fixed positionally with respect to the housing 20 and the spacer portion 30; a rectangular flat plate-shaped opening and closing portion 60 disposed behind the fixed portion 52 and configured to open and close; and a flexurally deformable hinge portion 58 that openably and closably connects the opening and closing portion 60 to the fixed portion 52. On a front end portion of the fixed portion 52, there are formed: fitting portions 53B which fit into the overhang portion 28 of the housing; and the electrical wire pressing portion 56B that protrudes toward the electrical wires 12 and presses the electrical wires 12.

The fitting portion 53B is a portion that has a U-shape cross section and is provided on a corner portion of the front end portion of the second cover 50B. In the fitting portion 53B, a fitting groove 54 configured to fit into the overhang portion 28 from above is formed. The fitting groove 54 engages with the overhang portion 28, thereby regulating movement of the second cover 50B in a direction different from an assembly direction thereof while guiding movement of the second cover 50B in the assembly direction.

The electrical wire pressing portion 56B presses the coatings 12B of the electrical wires 12 when the pair of covers 50A and 50B is assembled to each other, and extends across an overall width between the right and left side wall portions 63 in the first cover 50B. A tip end of the electrical wire pressing portions 56B is rounded and protrudes in a tapered shape, and a protruding dimension thereof is set to a dimension in which it is possible to prevent the electrical wires 12 from coming off without damaging the electrical wires 12.

Figure 22:
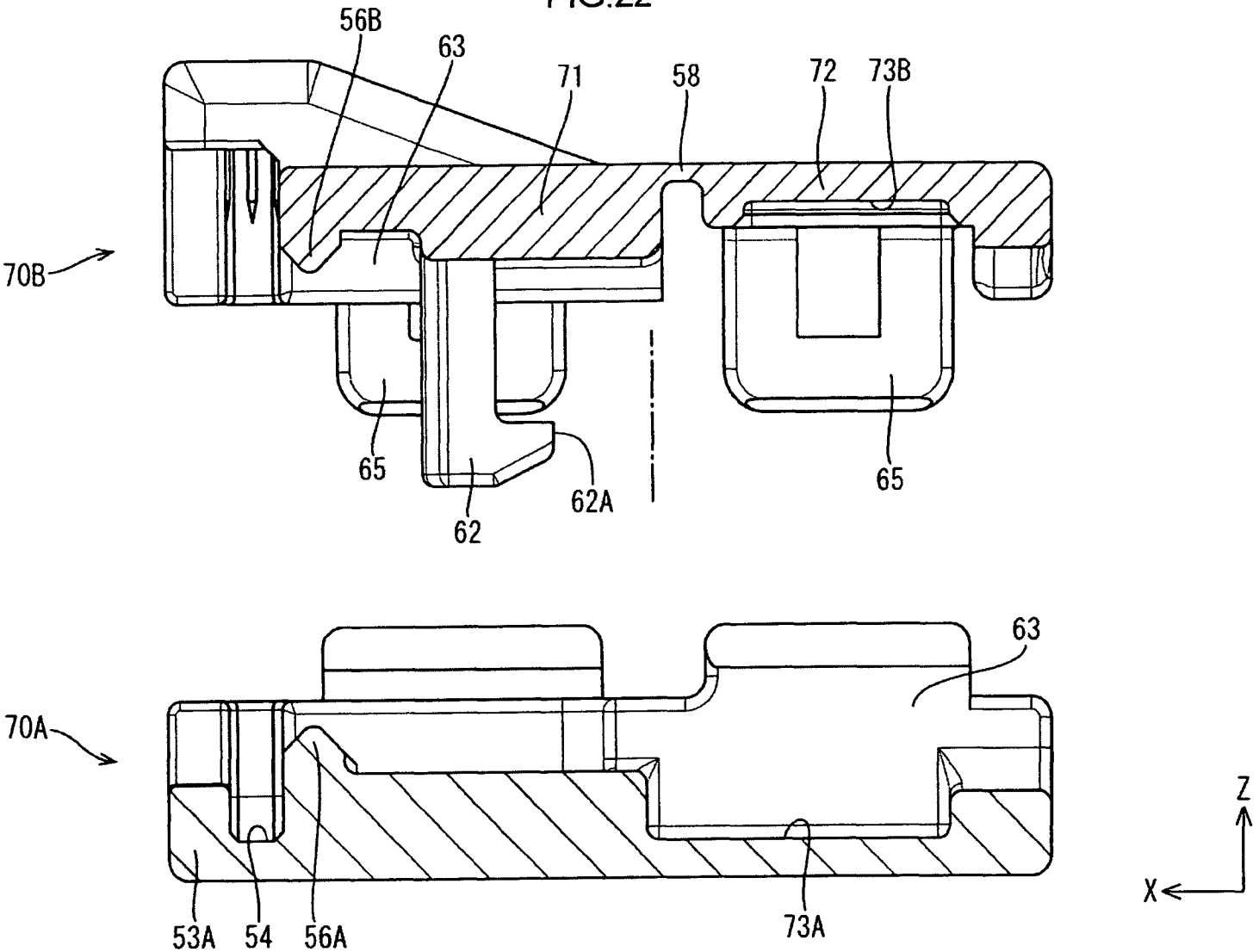
FIG. 22 is a C-C cross-sectional view of FIG. 21.
Figure 23:
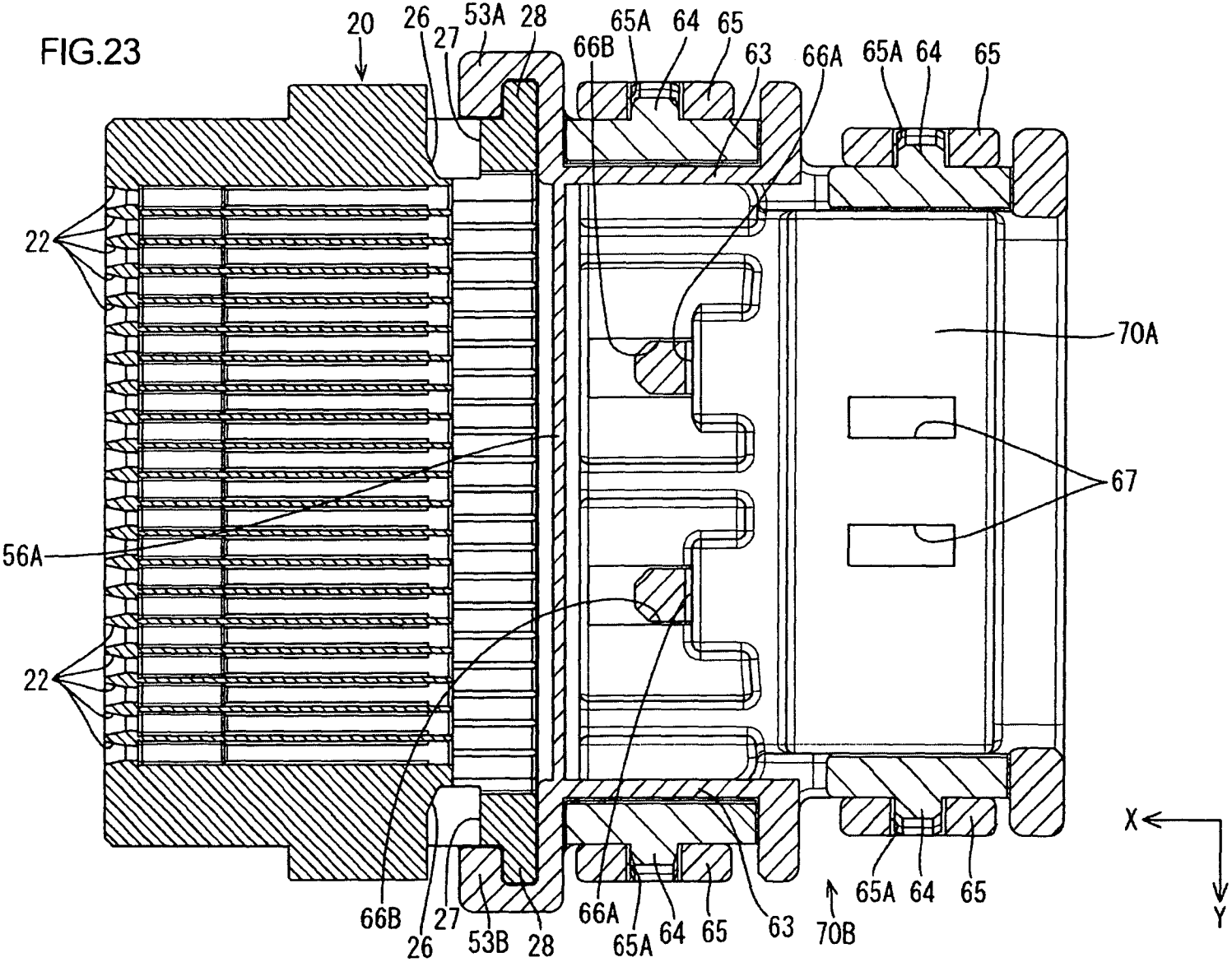
FIG. 23 is a planar sectional view showing a state where the pair of covers is assembled to a housing.
Figure 24:
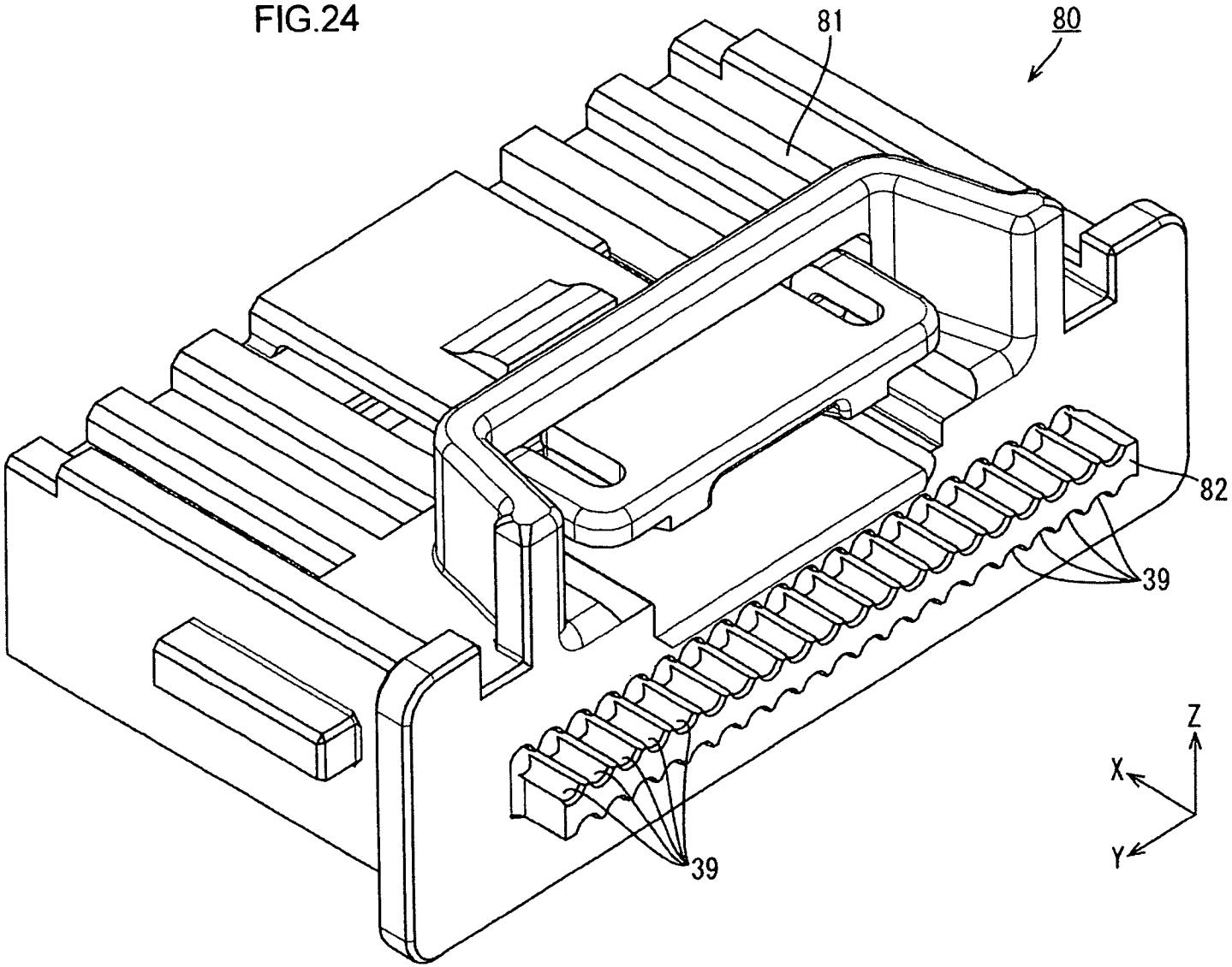
FIG. 24 is a perspective view showing a housing of a third embodiment.
Figure 25:
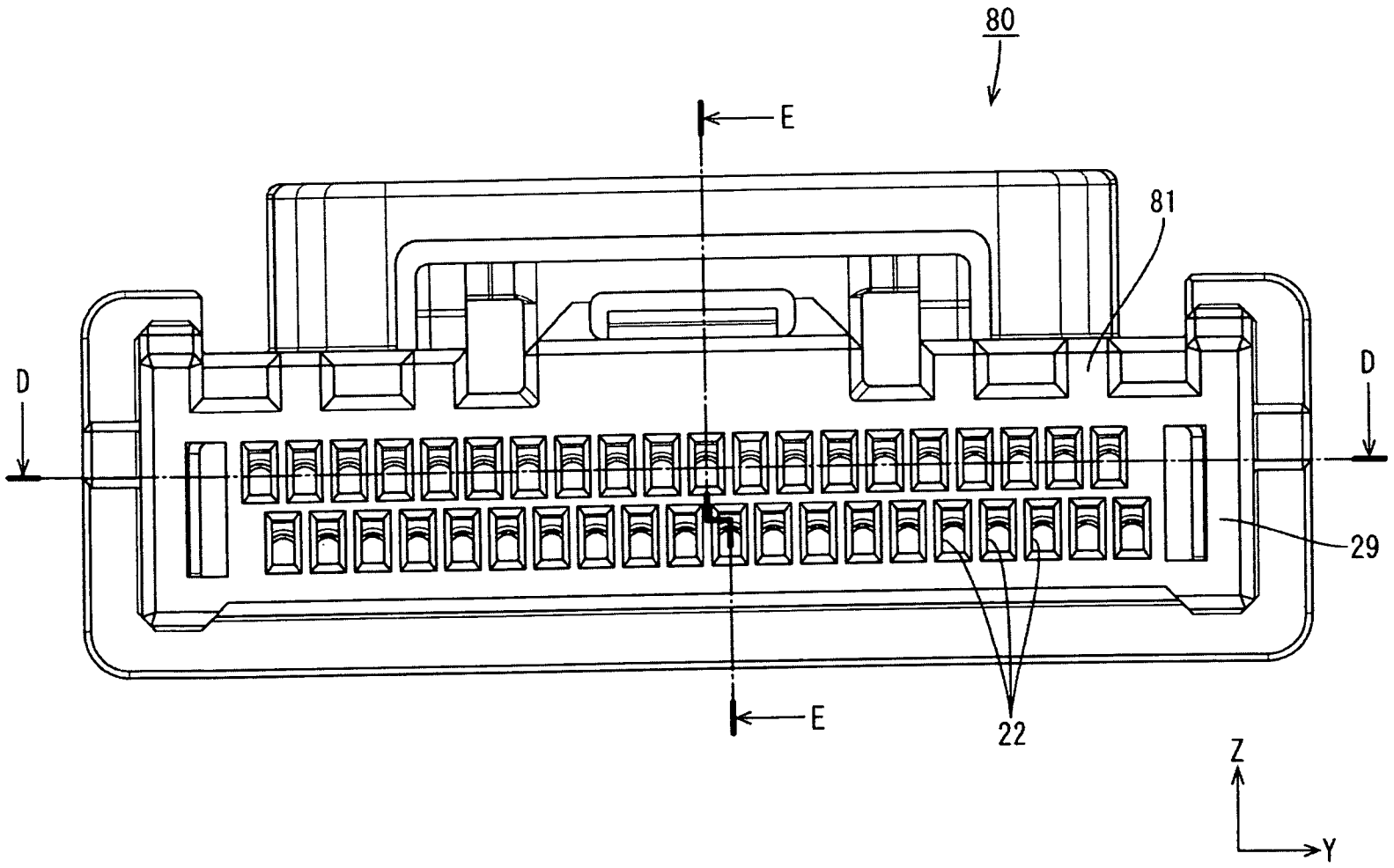
FIG. 25 is a front view showing the housing.
Figure 26:
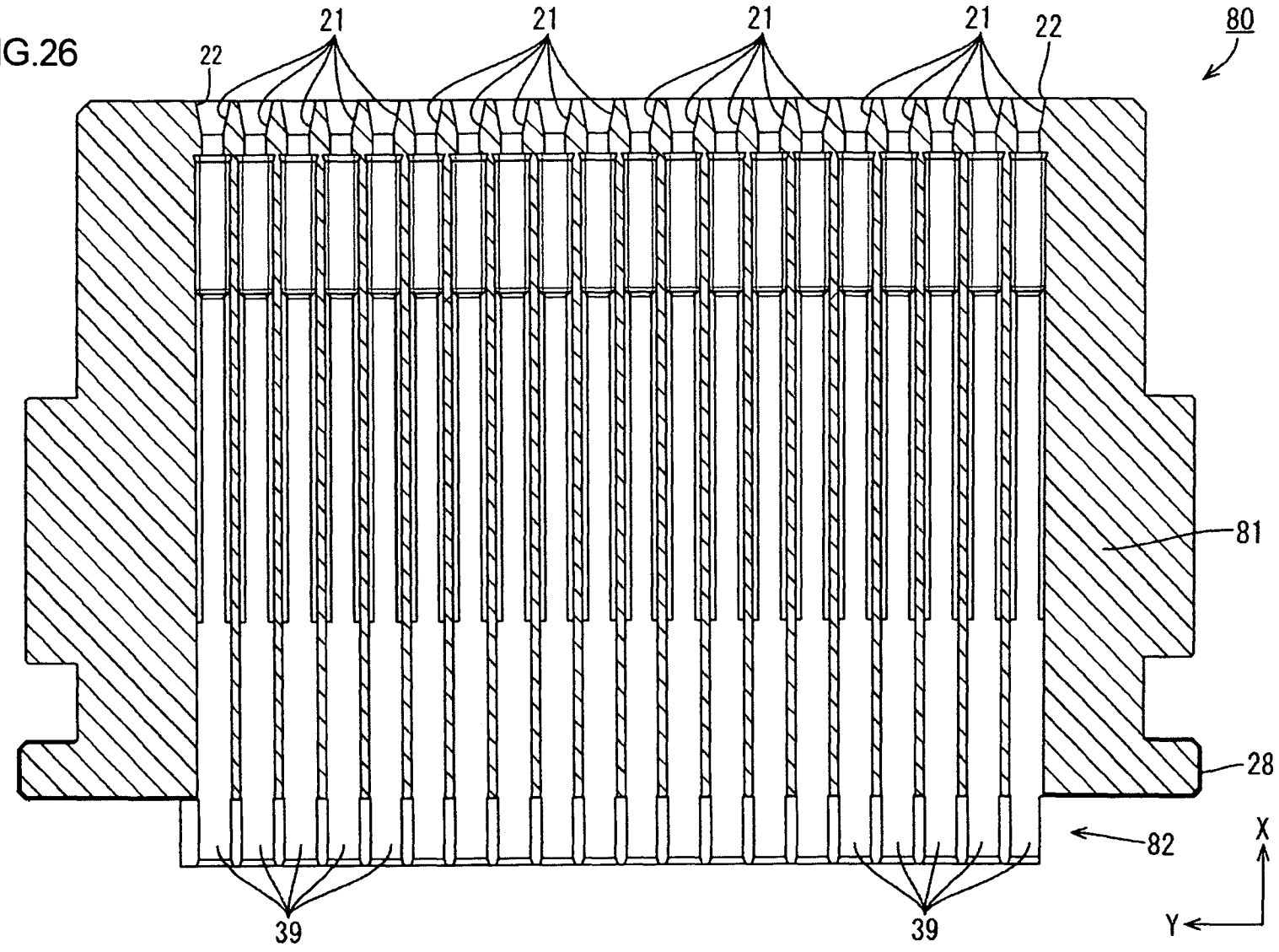
FIG. 26 is a D-D cross-sectional view of FIG. 25.
Figure 27:
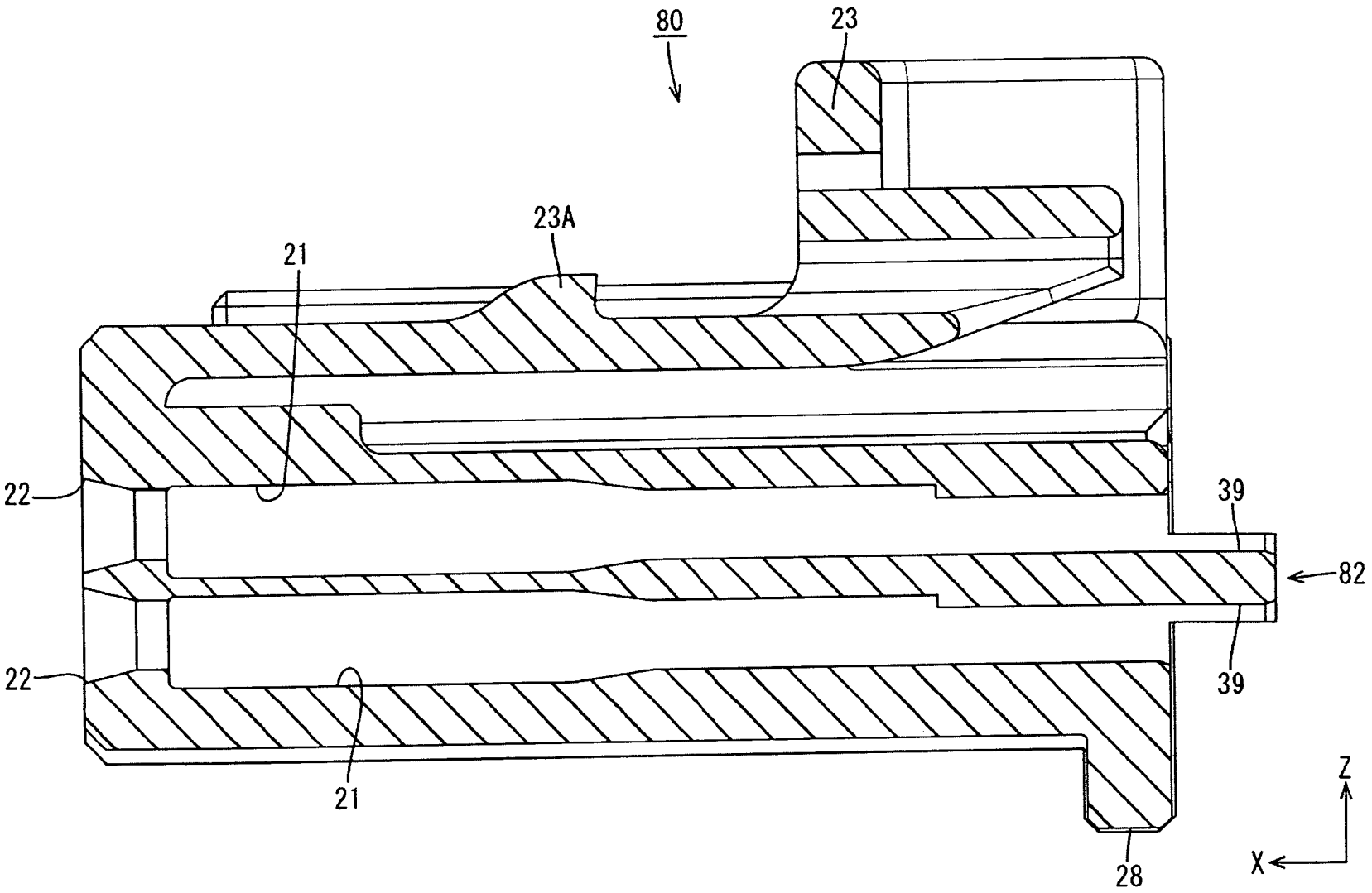
FIG. 27 is an E-E cross-sectional view of FIG. 25.

From the fixed portion 52, a pair of plate-shaped engaging pieces 62 (refer to FIG. 20 and FIG. 22) extends downward. On lower end portions of the respective engaging pieces 62, the respective engaging pieces 62 have engaging hooks 62A which protrude rearward. The engaging pieces 62 abut against the receiving portions 66A of the first cover 50A and are flexurally deformed, and when reaching a region below the receiving portions 66A, are restored and deformed and are engaged with lower surfaces of the receiving portions 66A. Moreover, the plurality of electrical wires 12 are inserted between the pair of engaging pieces 62, whereby a cabling route of the electrical wires 12 can be regulated.

As shown in FIG. 2, a thickness dimension of the opening and closing portion 60 is smaller than that of the fixed portion 52, and a length of the opening and closing portion 60 in a front and back direction is set longer than that of the fixed portion 52. A recessed portion 51B is formed on a lower surface of the opening and closing portion 60. By the thickness of the opening and closing portion 60 and by the recessed portions 51A and 51B of the covers 50A and 50B, a dimension of a gap between rear portions of the covers 50A and 50B is increased more than that between front portions thereof. In this way, with regard to rear regions of the covers 50A and 50B, a vertical dimension thereof at which it is possible to house the electrical wires 12 is increased. In a state where the outer circumferences of the plurality of electrical wires 12 are bundled by the tape 68 and are tied by the tie band 69 and a vertical thickness of the electrical wires 12 is increased, it is made possible to house the electrical wires 12 in a region between the recessed portions 51A and 51B on the rear portions of the covers 50A and 50B. Moreover, when the opening and closing portion 60 is opened with respect to the fixed portion 52, a space where it is possible to perform work such as bundling of the electrical wires 12 is formed on the first cover 50A. The cover body 51 is locally thinned, whereby the hinge portion 58 allows bending between the fixed portion 52 and the opening and closing portion 60.

A manufacturing process of the connector 10 will be described.

Figure 11:
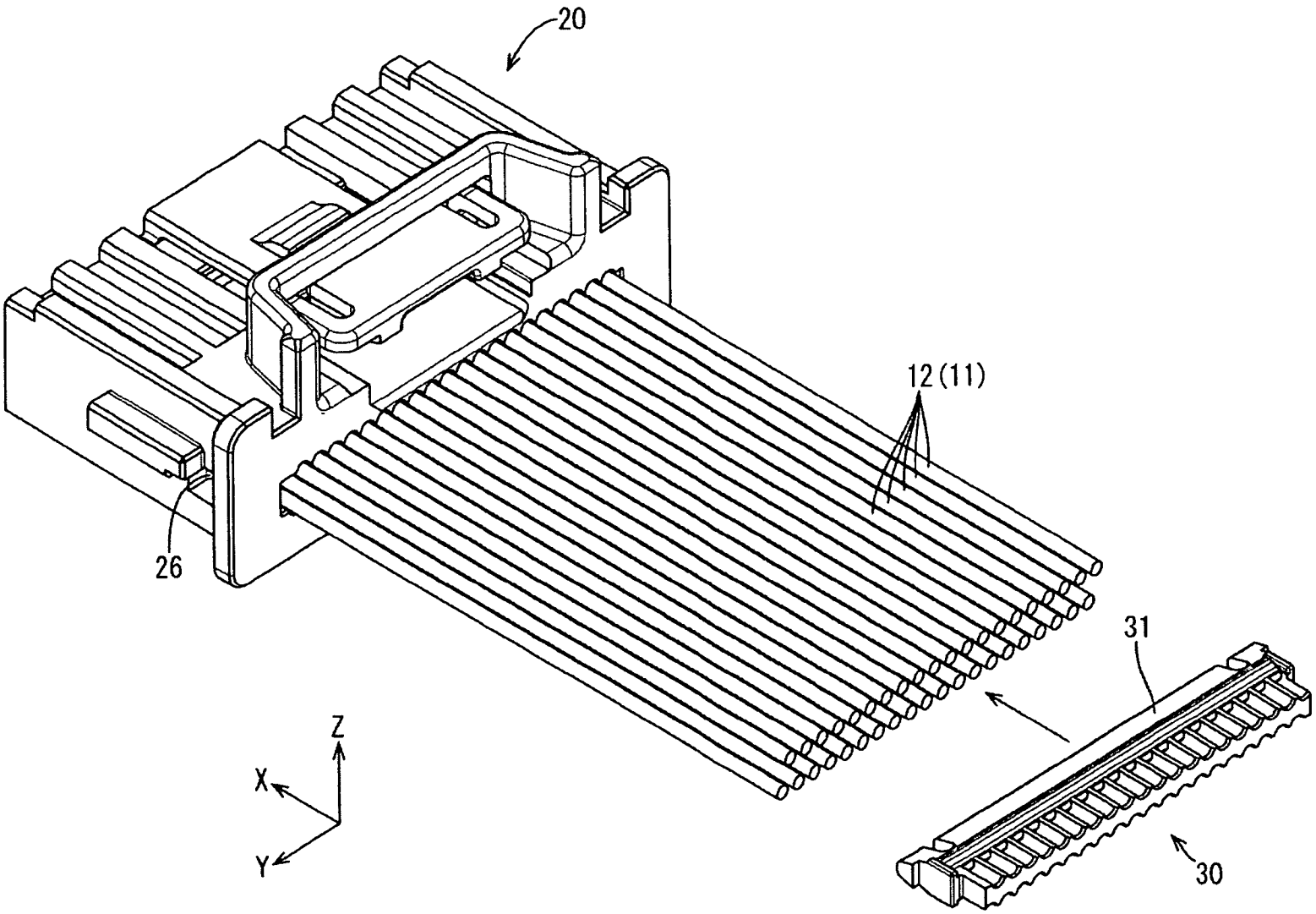
FIG. 11 is a perspective view explaining a step of assembling the spacer portion from a state where the terminal-attached electrical wires are assembled to the housing.
Figure 12:
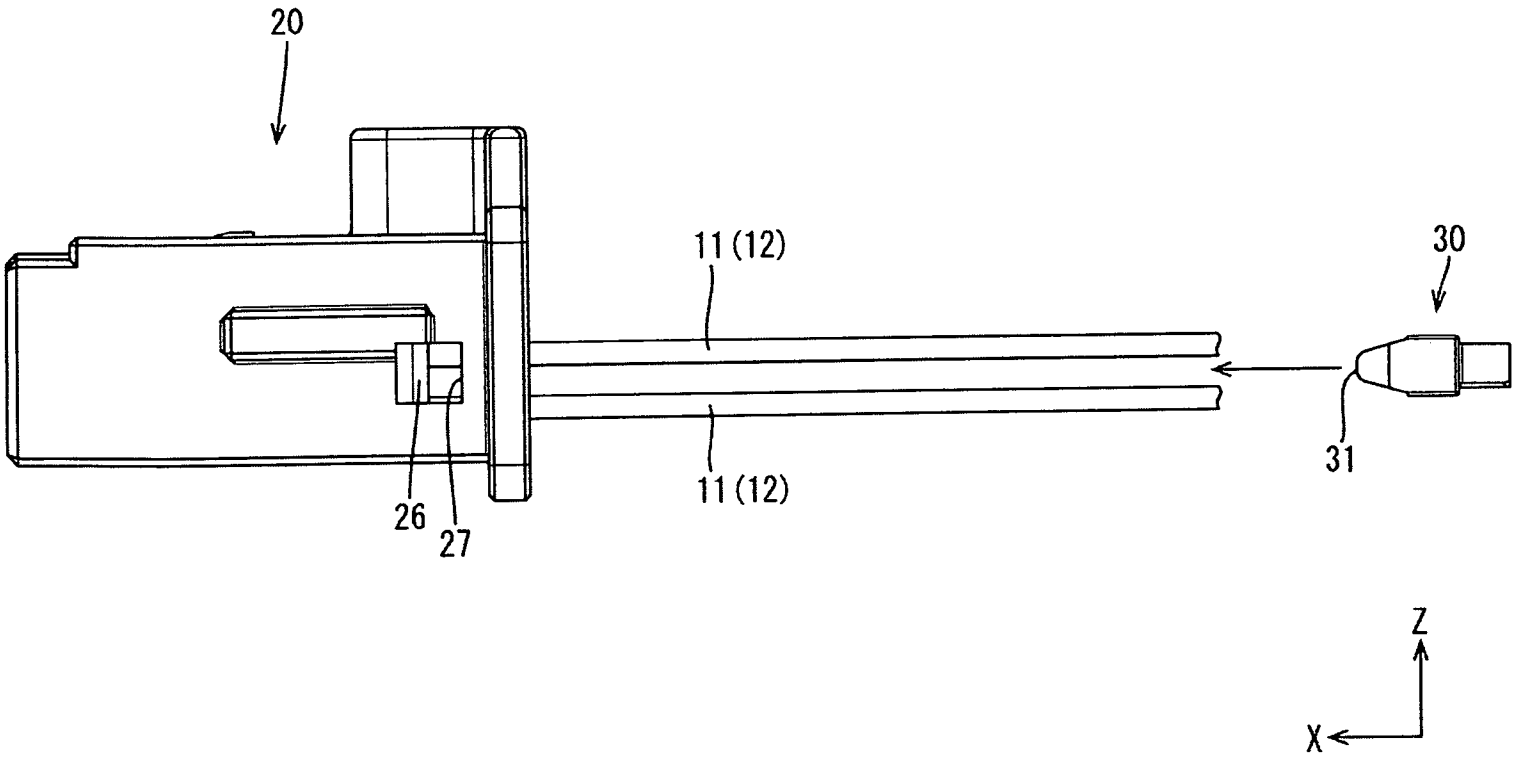
FIG. 12 is a side view explaining the step of assembling the spacer portion from the state where the terminal-attached electrical wires are assembled to the housing.
Figure 13:
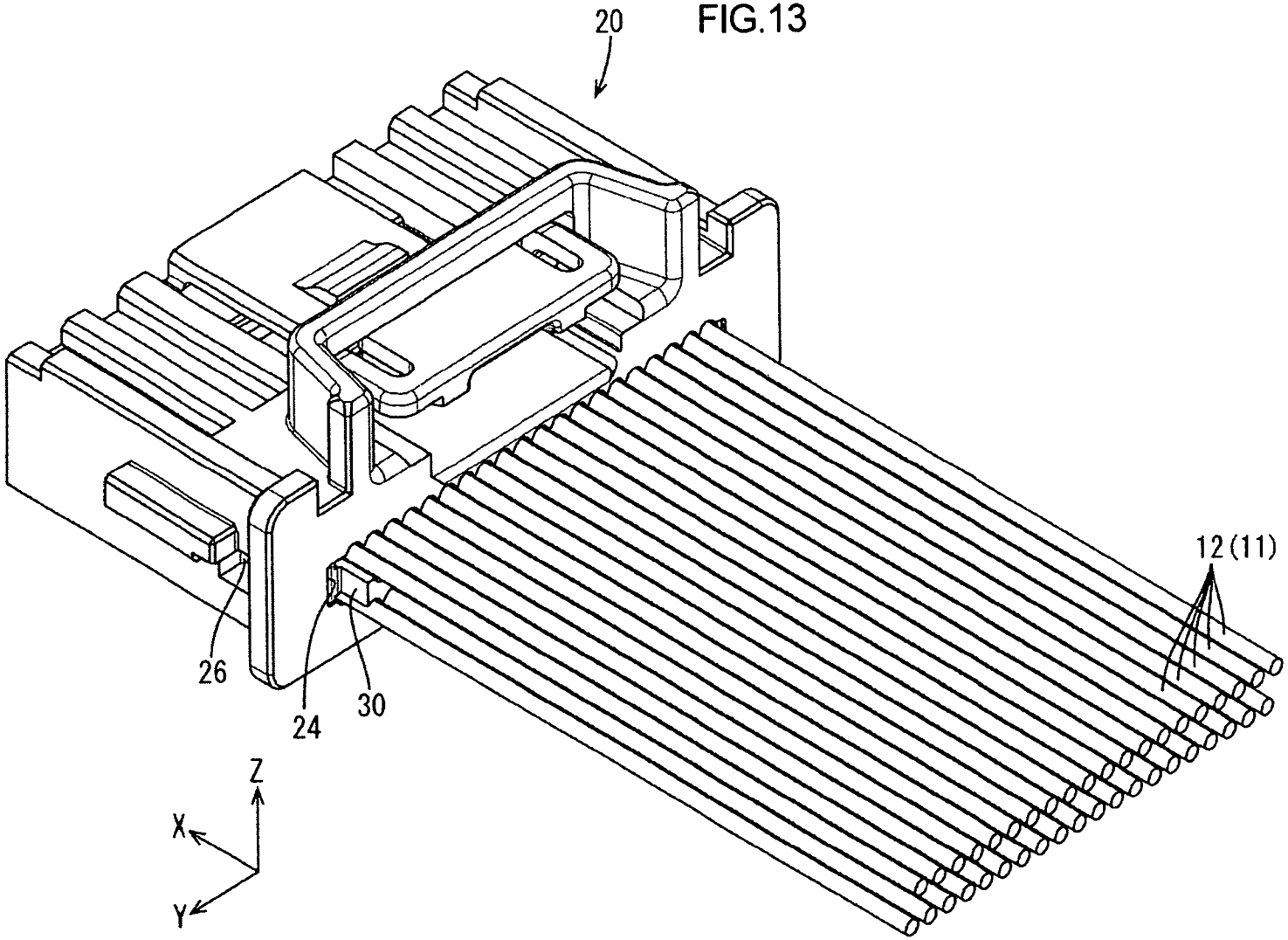
FIG. 13 is a perspective view showing a state where the spacer portion is assembled between the electrical wires in the housing.
Figure 14:
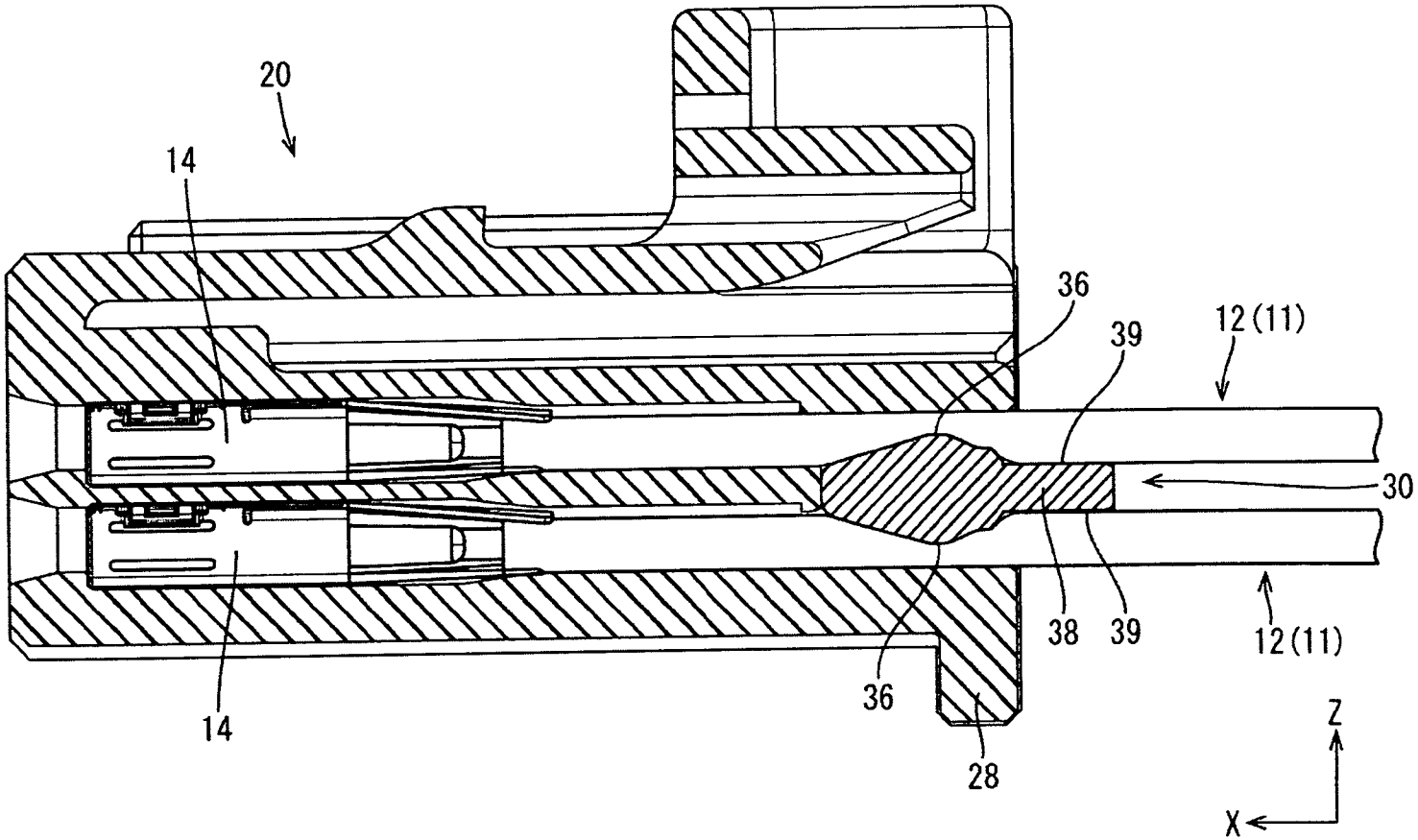
FIG. 14 is a longitudinal sectional view showing the state where the spacer portion is assembled between the electrical wires in the housing.

The terminals 14 are connected to the terminal ends of the plurality of electrical wires 12, thereby forming the plurality of terminal-attached electrical wires 11, and portions of the plurality of terminal-attached electrical wires 11, which are near the terminals 14, are inserted to specified positions of the terminal housing chambers 21 from the rear of the housing 20. Next, as shown in FIG. 11 and FIG. 12, the spacer portion 30 is inserted between the upper and lower electrical wires 12, and the spacer portion 30 is then inserted into the electrical wire lead-out portion 24 of the housing 20. In this way, the engaging protruding portions 33 and 33 of the spacer portion 30 are engaged with the engaging recessed portions 26 of the housing 20, and the spacer portion 30 turns to a state of being sandwiched between the upper and lower electrical wires 12 (FIG. 13).

Figure 15:
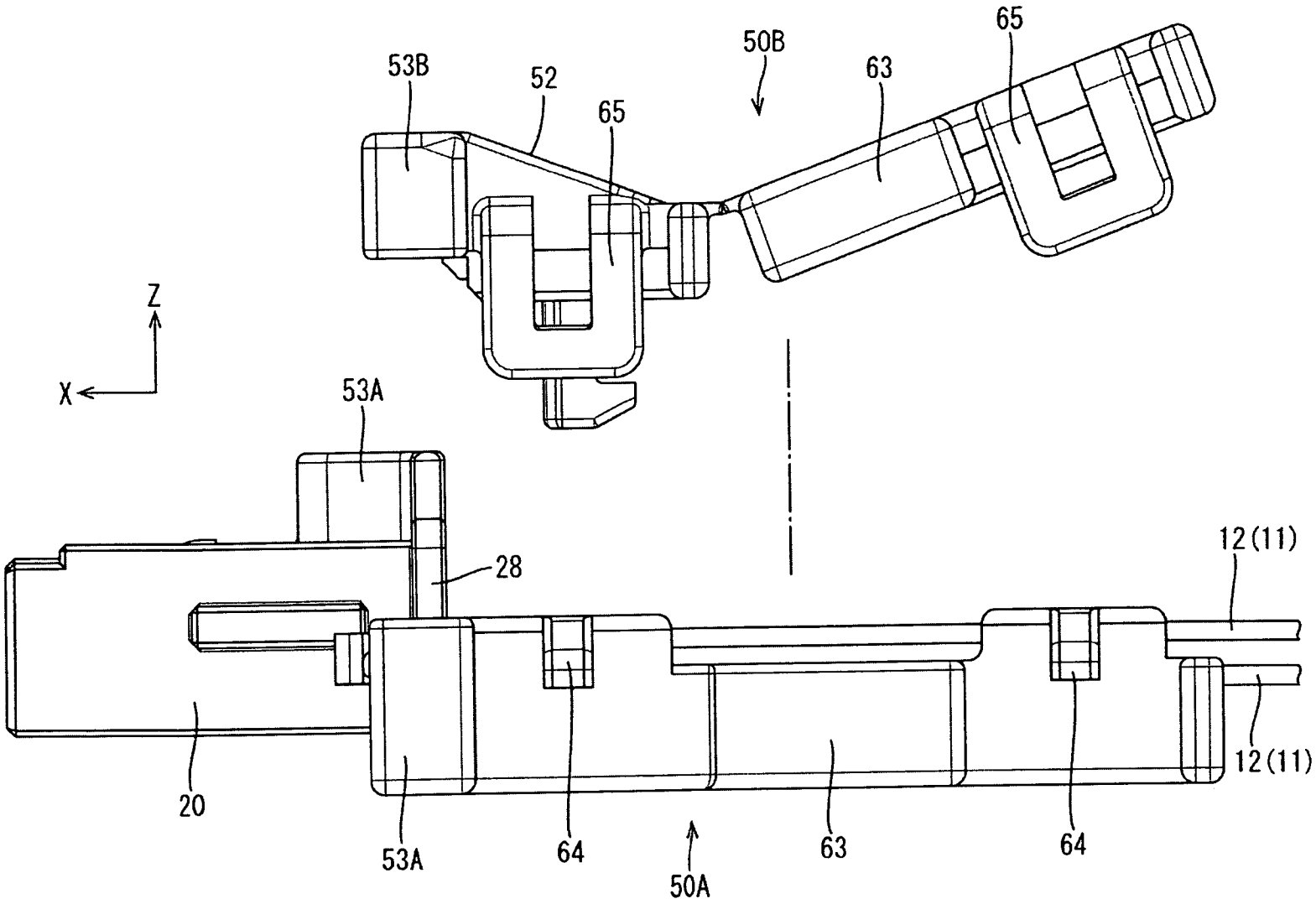
FIG. 15 is a side view explaining a step of assembling a first cover to a second cover.

Next, the first cover 50A is moved upward from below and attached such that the overhang portion 28 of the housing 20 is inserted into the fitting portion 53A of the first cover 50A (FIG. 15).

Next, the second cover 50B is moved downward, and the fitting portion 53B is inserted into the overhang portion 28 of the housing 20. Then, the engaged portions 65 of the second cover 50B, which have abutted against the engaging portions 64 of the first cover 50A, are flexurally deformed, and thereafter, are restored and deformed, and the engaging portions 64 of the fixed portion 52 are engaged with hole edges of the engaging holes 65A of the engaged portions 65. In this way, the fixed portion 52 of the second cover 50B is fixed to the first cover 50A and the housing 20. At this time, the engaged portions 65 of the opening and closing portion 60 are not engaged with the engaging portions 64, and the opening and closing portion 60 is left in an opened state.

Figure 16:
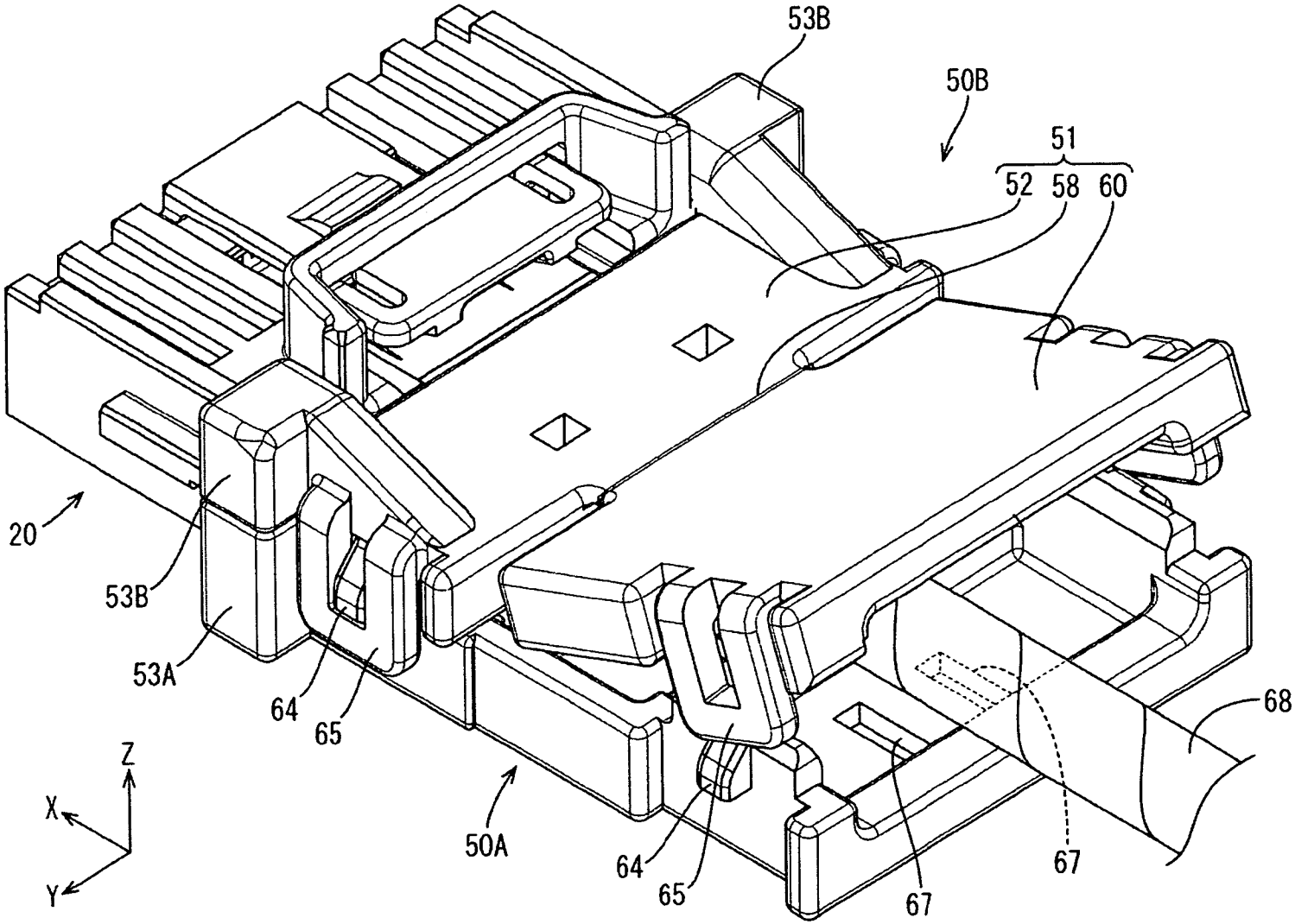
FIG. 16 is a side view showing a state where, in a state where an opening and closing cover is opened, a fixed portion of the second cover is assembled to the first cover, and a plurality of the electrical wires are subjected to tape winding.

Next, using a space generated by the opening of the opening and closing portion 60, the plurality of electrical wires 12 led out to the rear of the fixed portion 52 are bundled, and the tape 68 is wound around the outer circumferences of the plurality of electrical wires 12 (FIG. 16). Then, the tie band 69 is passed through the pair of through holes 67, and the plurality of electrical wires 12 around which the tape 68 is wound are tied by the tie band 69 (FIG. 17). Thereafter, the opening and closing portion 60 is rotationally moved in a closing direction, and the engaged portions 65 of the opening and closing portion 60 are engaged with the engaging portions 64, whereby the connector 10 is formed.

In accordance with the present embodiment, the following functions and effects are exerted.

The connector 10 includes: the terminals 14 connected to the terminal ends of the electrical wires 12; the housing 20 including the terminal housing chamber 21 in which the terminals 14 are housed and the electrical wire lead-out portion 24 from which the electrical wires 12 housed in the terminal housing chamber 21 are led out; the first cover 50A that covers the electrical wires 12 led out from the electrical wire lead-out portion 24; and the second cover 50B that causes the electrical wires 12 to be inserted between the second cover 50B itself and the first cover 50A in the state of being assembled to the first cover 50A. At least one of the first cover 50A and the second cover 50B include the electrical wire pressing portions 56A and 56B which press the electrical wires 12 led out from the electrical wire lead-out portion 24 in the state where the first cover 50A and the second cover 50B are assembled to each other.

In accordance with the present embodiment, the first cover 50A and the second cover 50B are assembled to each other, whereby the electrical wires 12 led out from the electrical wire lead-out portion 24 of the housing 20 are pressed by the electrical wire pressing portions 56A and 56B of (at least one of) the first cover 50A and the second cover 50B. In this way, even if force in a direction where the terminals 14 come off is applied to the electrical wires 12, the electrical wire pressing portions 56A and 56B press and hold the electrical wires 12 led out of the electrical wire lead-out portion 24, and accordingly, a stress generated on the terminals 14 is suppressed. Hence, it becomes possible to suppress the damage of the connection portions between the terminals 14 and the electrical wires 12 while simplifying the assembly process. The electrical wires 12 can be held using the configuration of the covers 50A and 50B which cover and protect the electrical wires 12, and accordingly, it becomes possible to miniaturize the connector 10.

At least one of the first cover 50A and the second cover 50B includes: the cover body 51 having the electrical wire pressing portion 56B; and the openable and closable opening and closing portion 60 connected to the cover body 51 via the hinge portion 58.

With such a configuration, the opening and closing portion 60 is opened in the state where the first cover 50A and the second cover 50B are assembled to each other, whereby a work space for the work of bundling the electrical wires 12 can be ensured.

The plurality of terminals 14 connected to the terminal ends of the plurality of electrical wires 12 are provided. The plurality of electrical wires 12 led out from the electrical wire lead-out portion 24 are arrayed in the assembly direction of the first cover 50A and the second cover 50B. The spacer portion 30 sandwiched between the plurality of electrical wires 12 arrayed in the assembly direction of the first cover 50A and the second cover 50B is provided.

In the configuration in which the plurality of electrical wires 12 are arrayed in the assembly direction of the first cover 50A and the second cover 50B, there is concern that the force by which the electrical wire pressing portions 56A and 56B press the electrical wires 12 may decrease by gaps between the electrical wires 12. In accordance with the present embodiment, the electrical wire pressing portions 56A and 56B press the electrical wires 12 in the state where the spacer portion 30 is sandwiched between the plurality of electrical wires 12, and accordingly, the electrical wire holding force by the electrical wire pressing portions 56A and 56B can be suppressed from decreasing.

The electrical wire lead-out portion 24 is recessed with respect to the outer surface of the housing 20, and the spacer portion 30 includes the tapered portion 31 that has a tapered shape and enters the electrical wire lead-out portion 24.

In this way, it becomes easy to assemble the spacer portion 30, and it becomes easy to position the spacer portion 30 between the electrical wires 12.

The housing 20 includes the overhang portion 28 that overhangs outward, and the first cover 50A and the second cover 50B include the fitting portions 53A and 53B which fit into the overhang portion 28 in the assembly direction of the first cover 50A and the second cover 50B.

In this way, it becomes possible to position the first cover 50A and the second cover 50B with respect to the housing 20 while facilitating the assembly work of the first cover 50A and the second cover 50B by the fitting portions 53A and 53B.

Second Embodiment

Next, a second embodiment will be described with reference to FIG. 18 to FIG. 23. In the second embodiment, with regard to a second cover 70B, relative lengths of a fixed portion 71 and an opening and closing portion 72 are changed, and in addition, a first cover 70A is caused to correspond to the second cover 70B. Hereinafter, the same reference numerals are assigned to the same constituents as those of the first embodiment, and a description thereof will be omitted.

Figure 19:
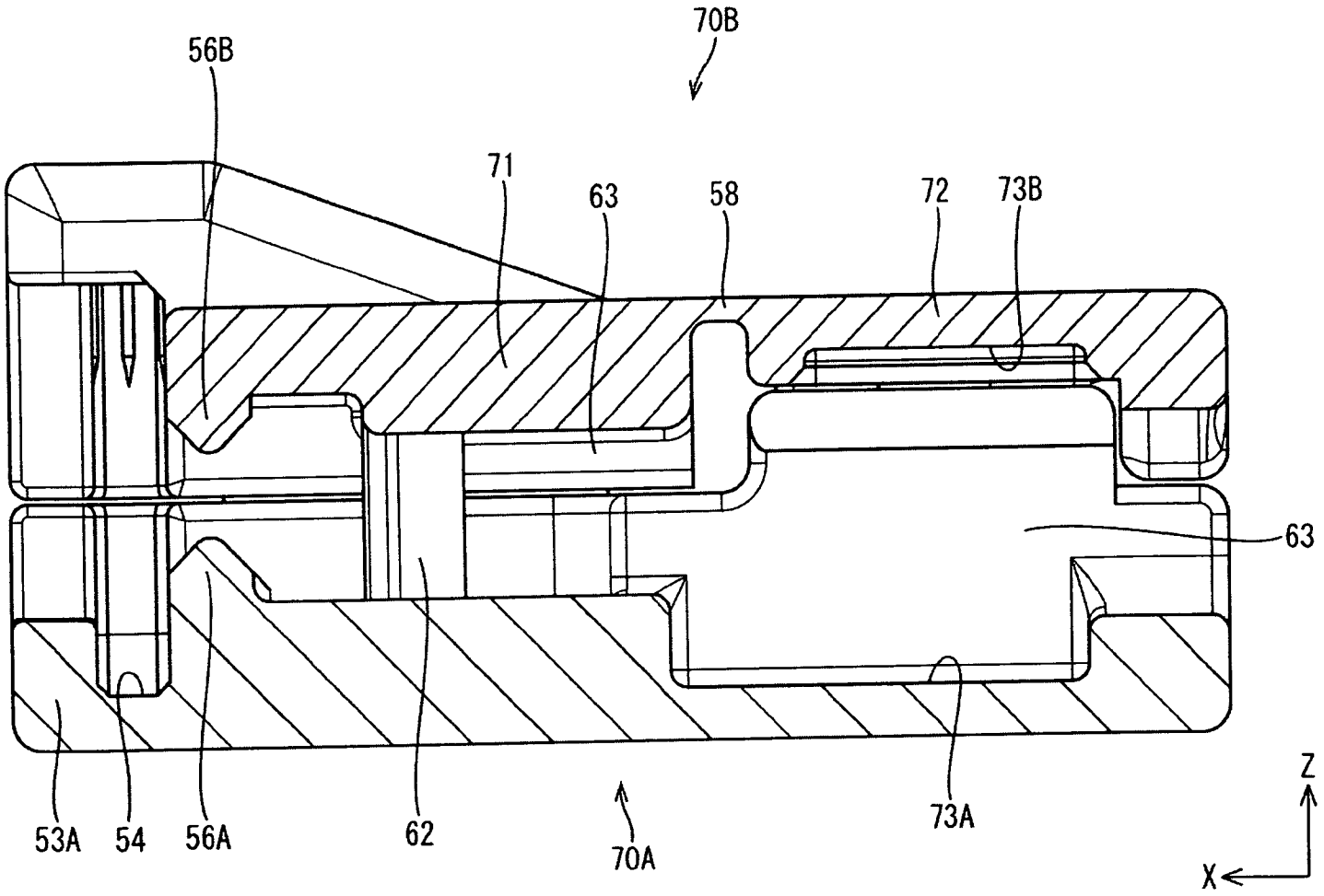
FIG. 19 is a B-B cross-sectional view of FIG. 18.

In the second cover 70B of the second embodiment, as shown in FIG. 19, the fixed portion 71 and the opening and closing portion 72 are caused to have substantially the same length in the front and back direction. On the rear of the covers 70A and 70B, recessed portions 73A and 73B are formed.

Third Embodiment

Next, a third embodiment will be described with reference to FIG. 24 to FIG. 27. In the third embodiment, with regard to a housing 80, a spacer portion 82 is formed integrally therewith. Hereinafter, the same reference numerals are assigned to the same constituents as those of the first embodiment, and a description thereof will be omitted.

The housing 80 is made of synthetic resin, and as shown in FIG. 24 to FIG. 27, includes: a flat cuboidal housing body 81; and the spacer portion 82 fixed to a rear end portion of a housing body 81. In the housing 80, the housing body 81 and the spacer portion 82 are formed integrally with each other, for example, by mold forming, and the housing 80 does not include the separate spacer portion 30 as in the first embodiment. Accordingly, the engaging recessed portions 26 in the first embodiment are not provided in the housing body 81, and engaging protruding portions 33 and 33 and a tapered portion 31 are not provided in the spacer portion 82.

On the rear of the housing body 81, the plate-shaped spacer portion 82 (electrical wire mounting portion) configured to mount the electrical wires 12 thereon protrudes. On both upper and lower surfaces of the spacer portion 82, a plurality of electrical wire cabling grooves 39 which go along outer circumferences of the electrical wires 12 are formed crosswise in line.

Other Embodiments

The technology described in the present description is not limited to the embodiments described by the above description and with reference to the drawings. For example, embodiments as below are incorporated within the technical scope of the technology described in the present description.

(1) In the above embodiments, both of the covers 50A and 50B making a pair and both of the covers 70A and 70B making a pair are configured to include the electrical wire pressing portions 56A and 56B; however, without being limited to this, only one cover in the pair of covers may be configured to include the electrical wire pressing portion that presses the electrical wire 12. Moreover, both of the covers 50A and 50B making a pair and both of the covers 70A and 70B making a pair are configured to include the fitting portions 53A and 53B; however, only one cover in the pair of covers may be configured to include the fitting portion.

(2) Each of the first covers 50A and 70A is configured to include the opening and closing portion 60 openable and closable by the hinge portion 58; however, may be configured not to include the opening and closing portion 60 and the hinge portion 58.

(3) The above embodiments are configured to include the spacer portions 30 and 82; however, may be configured not to include the spacer portion.

(4) The above embodiments are configured to include the electrical wires 12 on the plurality of stages; however, are not limited to this. For example, from upper and lower sides of the electrical wires 12 on a single stage, the electrical wires 12 on the single stage may be sandwiched and held from both upper and lower sides by the electrical wire pressing portions 56A and 56B of the pair of covers 50A and 50B and the pair of covers 70A and 70B.

(5) The connector 10 is configured to bundle the electrical wires 12 and tie the bundled electrical wires 12 by the tying member; however, is not limited to this. For example, the electrical wires 12 may extend linearly without being bundled behind the housing 80.

EXPLANATION OF SYMBOLS

10: Connector
11: Terminal-attached electrical wire
12: Electrical wire
14: Terminal
20, 80: Housing
21: Terminal housing chamber
24: Electrical wire lead-out portion
25: Electrical wire lead-out port
26: Engaging recessed portion
30, 82: Spacer portion
31: Tapered portion
32: Inclined surface
33: Engaging protruding portion
36: Thick portion
38: Electrical wire mounting portion
50A, 70A: First cover
50B, 70B: Second cover
51: Cover body
52, 71: Fixed portion
53A, 53B: Fitting portion
56A, 56B: Electrical wire pressing portion
58: Hinge portion
60, 72: Opening and closing portion
62: Engaging piece
63: Side wall portion
64: Engaging portion
65: Engaged portion
60: Tie band (Tying member)

What is claimed is:

1. A connector comprising:

at least one terminal connected to a terminal end of at least one electrical wire;

a housing including a terminal housing chamber in which the at least one terminal is housed and an electrical wire lead-out portion from which the at least one electrical wire housed in the terminal housing chamber is led out;

a first cover covering the at least one electrical wire led out from the electrical wire lead-out portion, the first cover including a first cover body fixed to the housing and an engaging portion protruding from the first cover body; and a second cover covering the at least one electrical wire led out from the electrical wire lead-out portion, the second cover including a second cover body and an engaged portion, the second cover body including:

a fixed portion fixed to the housing and including an electrical wire pressing portion pressing the at least one electrical wire;

an opening and closing portion; and a hinge portion connecting the opening and closing portion to the fixed portion, the engaged portion protruding from the fixed portion and engaging in the engaging portion of the first cover so that the opening and closing portion pivots on the hinge portion for opening and closing.

2. The connector according to claim 1, wherein the at least one electrical wire includes electrical wires led out from the electrical wire lead-out portion and arranged to define first and second substantially parallel arrays, the at least one terminal includes terminals connected to terminal ends of the electrical wires, and the connector further comprises a spacer extending from the electrical wire lead-out portion and being sandwiched between the electrical wires of the first array and the electrical wires of the second array.

3. The connector according to claim 2, wherein the electrical wire lead-out portion is recessed with respect to an outer surface of the housing, and the spacer includes a tapered portion that has a tapered shape and enters is mounted in the electrical wire lead-out portion.

4. The connector according to claim 1, wherein the housing includes a flange that projects outward, and the first cover and the second cover include fitting portions that fit around the flange in assembly directions of the first cover and the second cover.

5. The connector according to claim 4, wherein at least the first cover includes at least two through holes that hold a tying member that ties the plurality of electrical wires to the first cover.

6. The connector according to claim 5, wherein the second cover includes:

the first cover body includes a first electrical wire pressing portion pressing the electric wires of the first array; and the opening and closing portion being opposed to the through holes of the first cover and the tying member held in the through holes.

7. The connector according to claim 6, wherein the spacer has opposite first and second surfaces, the first surface having first grooves respectively receiving the electrical wires of the first array, the second surface having second grooves respectively receiving the electrical wires of the second array, the wire pressing portion of the second cover body is defined as a second electrical wire pressing portion, the first electrical wire pressing portion and the second electrical wire pressing portion extend transverse to the electrical wires, and the second electrical wire pressing portion presses the electrical wires of the second array.

8. The connector according to claim 7 wherein the first grooves are offset from the second grooves.

9. The connector according to claim 2, wherein the spacer is integral with the housing.

10. The connector of claim 3, wherein the housing includes engaging recesses that extend from the outer surface of the housing into the electric wire lead-out portion, the spacer including engaging protrusions that engage in the engaging recesses to hold the spacer at least partly within the electric wire lead-out portion.

* * * * *